US009685723B2

(12) United States Patent
Kee Mew

(10) Patent No.: US 9,685,723 B2
(45) Date of Patent: Jun. 20, 2017

(54) CARD EDGE CONNECTOR AND CARD EDGE CONNECTOR ASSEMBLY

(71) Applicant: Molex, LLC, Lisle, IL (US)

(72) Inventor: Jonathan Ah-Fat Kee Mew, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/151,555

(22) Filed: May 11, 2016

(65) Prior Publication Data

US 2016/0336667 A1 Nov. 17, 2016

(30) Foreign Application Priority Data

May 11, 2015 (CN) ..... 2015 1 0236256

(51) Int. Cl.

| | |
|---|---|
| ***H01R 13/62*** | (2006.01) |
| ***H01R 12/73*** | (2011.01) |
| ***H01R 12/70*** | (2011.01) |
| *H01R 12/72* | (2011.01) |

(52) U.S. Cl.

CPC ..... *H01R 12/737* (2013.01); *H01R 12/7005* (2013.01); *H01R 12/721* (2013.01)

(58) Field of Classification Search

CPC ..... H01R 23/7005; H01R 23/7068; H01R 13/639; H01R 13/62938; H01R 13/62955; H01R 13/635

USPC ..... 439/157, 159, 160, 327, 328

See application file for complete search history.

(56) References Cited

U.S. PATENT DOCUMENTS

| | | | | |
|---|---|---|---|---|
| 5,842,880 | A * | 12/1998 | Pei | H01R 12/7005 439/327 |
| 6,027,358 | A | 2/2000 | Lai et al. | |
| 7,371,097 | B1 * | 5/2008 | Pennypacker | H01R 13/6275 439/327 |
| 7,828,566 | B2 * | 11/2010 | Chen | H05K 7/1431 439/157 |
| 8,385,080 | B2 * | 2/2013 | Kim | H05K 7/00 361/760 |

FOREIGN PATENT DOCUMENTS

CN 203660106 U 6/2014

* cited by examiner

*Primary Examiner* — Hien Vu

(74) *Attorney, Agent, or Firm* — Stephen L. Sheldon

(57) ABSTRACT

A card edge connector comprises an insulating body and a metal strengthening member. The insulating body comprises a card slot and a tower. The tower comprises a first side wall, a second side wall, a first guiding wall and a second guiding wall. A first mounting groove is formed between the first side wall and the first guiding wall, a second mounting groove is formed between the second side wall and the second guiding wall, a guiding groove is formed between the first guiding wall and the second guiding wall. The metal strengthening member comprises a base portion, a first side portion, a second side portion, a first elastic arm and a second elastic arm. The first elastic arm and the second elastic arm extend toward the guiding groove and are respectively adjacent to the first guiding wall and the second guiding wall.

18 Claims, 21 Drawing Sheets

CARD EDGE CONNECTOR AND CARD EDGE CONNECTOR ASSEMBLY

RELATED APPLICATIONS

This application claims priority to Chinese Application No. 201510236256.7, filed May 11, 2015, which is incorporated herein by reference in its entirety.

TECHNICAL FIELD

The present disclosure relates to a card edge connector and a card edge connector assembly.

BACKGROUND ART

In a computer system, a card edge connector is used for insertion of an electronic card, such as a memory module. The card edge connector mainly functions to input a signal into the electronic card or output a signal from the electronic card to other element of the computer system. Therefore, the electronic card preferably can be reliably inserted into the card edge connector so as to allow the computer system to operate properly. In addition, when an electronic card is inserted downwardly into card edge connector along a vertical or up-down direction, the card edge connector must also tolerate repeatedly engagement with the he electronic card without deforming. It turns out that traditional card edge connectors do not address these issues in a desirable manner. Chinese utility model patent application CN97214647.4 (corresponding to Taiwanese patent application TW85220265 and U.S. Pat. No. 6,027,358) discloses a connector with a card retention means, the connector comprises an insulating body, a latching means and a card retention means. The insulating body is provided with a slot, a rail and a mounting portion. The slot is configured to receive a card. The rail is used to receive a side edge of the card. The mounting portion is used to mount the card retention means. The latching means is mounted to the insulating body so as to latch the card. However, the card retention means is mounted above a top end of the rail, and two elastic arms of the card retention means are completely exposed relative to the rail. Consequentially, when a card is inserted into the card slot in a vertical direction the card can often directly collide with a top portion of the elastic arm and damage the elastic arm so as to cause the connector to improperly function. It is even possible, in certain instances, for the elastic arm to be deformed when the card is attempted to be inserted into the card slot so that it elastic arms get pressed into into a receiving path of the rail so as to block further insertion of the card. Thus, certain individuals would appreciate an improved card edge connector system.

SUMMARY OF THE INVENTION

A card edge connector is disclosed. The card edge connector comprises an insulating body and a metal strengthening member. The insulating body includes a card slot and a tower. The tower includes a first side wall and a second side wall that are positioned so that the card slot is between the first and second side walls. The tower includes a first guiding wall and a second guiding wall, the first guiding wall and the second guiding wall extend transversely to the first side wall and the second side wall respectively and face each other. A first mounting groove is formed between the first side wall and the first guiding wall, a second mounting groove is formed between the second side wall and the second guiding wall, a guiding groove is formed between the first guiding wall and the second guiding wall. The metal strengthening member comprises a base portion, a first side portion, a second side portion, a first elastic arm and a second elastic arm. The first side portion and the second side portion extend respectively from two sides of the base portion toward the inside direction. The first elastic arm and the second elastic arm extend transversely respectively from the first side portion and the second side portion toward the guiding groove. The first side portion and the second side portion are respectively mounted to the first mounting groove and the second mounting groove. The first elastic arm is adjacent to a side wall of the first guiding wall, extends transversely beyond a covering range of the side wall of the first guiding wall and extends into the guiding groove; the second elastic arm is adjacent to a side wall of the second guiding wall, extends transversely beyond a covering range of the side wall of the second guiding wall and extends into the guiding groove.

In another embodiment, a card edge connector assembly is disclosed. The card edge connector assembly comprises a circuit board and a card edge connector. The circuit board comprises a plurality of soldering points. The card edge connector comprises an insulating body, a plurality of terminals and a metal strengthening member. The insulating body includes a card slot and a tower. The tower includes a first side wall and a second side wall that are positioned so that the card slot is between the first and second side walls. The tower includes a first guiding wall and a second guiding wall, the first guiding wall and the second guiding wall extend transversely to the first side wall and the second side wall respectively and face each other. A first mounting groove is formed between the first side wall and the first guiding wall, a second mounting groove is formed between the second side wall and the second guiding wall, a guiding groove is formed between the first guiding wall and the second guiding wall. A first mounting groove is formed between the first side wall and the first guiding wall, a second mounting groove is formed between the second side wall and the second guiding wall, a guiding groove is formed between the first guiding wall and the second guiding wall, the electronic card is inserted into the card slot along the guiding groove. The plurality of terminals are arranged along the card slot. The metal strengthening member comprises a base portion, a first side portion, a second side portion, a first elastic arm and a second elastic arm. The first side portion and the second side portion extend respectively from two sides of the base portion toward the inside direction. The plurality of terminals are respectively coupled to the plurality of soldering points. The first elastic arm and the second elastic arm extend transversely respectively from the first side portion and the second side portion toward the guiding groove. The first side portion and the second side portion are respectively mounted to the first mounting groove and the second mounting groove. The first elastic arm is adjacent to a side wall of the first guiding wall, extends transversely beyond a covering range of the side wall of the first guiding wall and extends into the guiding groove; the second elastic arm is adjacent to a side wall of the second guiding wall, extends transversely beyond a covering range of the side wall of the second guiding wall and extends into the guiding groove. When the electronic card is inserted into the card slot, the first elastic arm and the second elastic arm elastically clamp the electronic card from two sides of the electronic card, and the electronic card is electrically connected to the plurality of terminals.

In an embodiment, the card edge connector includes a latching-ejecting member that is configured to latch and lock an inserted electronic card. The latching-ejecting member is pivotally supported by the tower and has a latching portion at an upper end of the latching-ejecting member, and the latching-ejecting member has an ejecting portion at a lower end of the latching-ejecting member. The tower is provided with a latching-ejecting member mounting portion on an outer side of the connecting wall and when the electronic card is inserted into the card slot, the ejecting portion supports a lower edge of the electronic card, the latching-ejecting member is pivoted in the latching-ejecting member mounting portion and the latching portion is translated into a card notch of the electronic card.

DETAILED DESCRIPTION OF THE PREFERRED EMBODIMENTS

In order to allow a person skilled in the art to completely understand the present disclosure, detailed steps and configuration will be presented in the following description. Obviously, realization is not limited to specific details known by a person skilled in relevant art. On the other hand, well known configuration or steps are not described in relevant detail, so as to avoid unnecessary limitation on the present disclosure. Specific embodiments will be described in detail as follows. However, besides these detailed descriptions, the present disclosure further may be widely implemented in other embodiments, and the scope is not limited to that, and is determined by the appended claims.

As can be appreciated, one benefit of the depicted designs is that connector allows for insertion of electronic card in a more stable manner with less vibration and swaying of the electronic card. The depicted design may further prevent an elastic arm from being deflected and in turn deformed by a lower edge of the electronic card. Moreover, a metal strengthening member may also strengthen a part of the tower between two the side walls of a tower, so as to prevent a connecting wall from being deflected and in turn fractured by the inserted electronic card.

Figure 1:
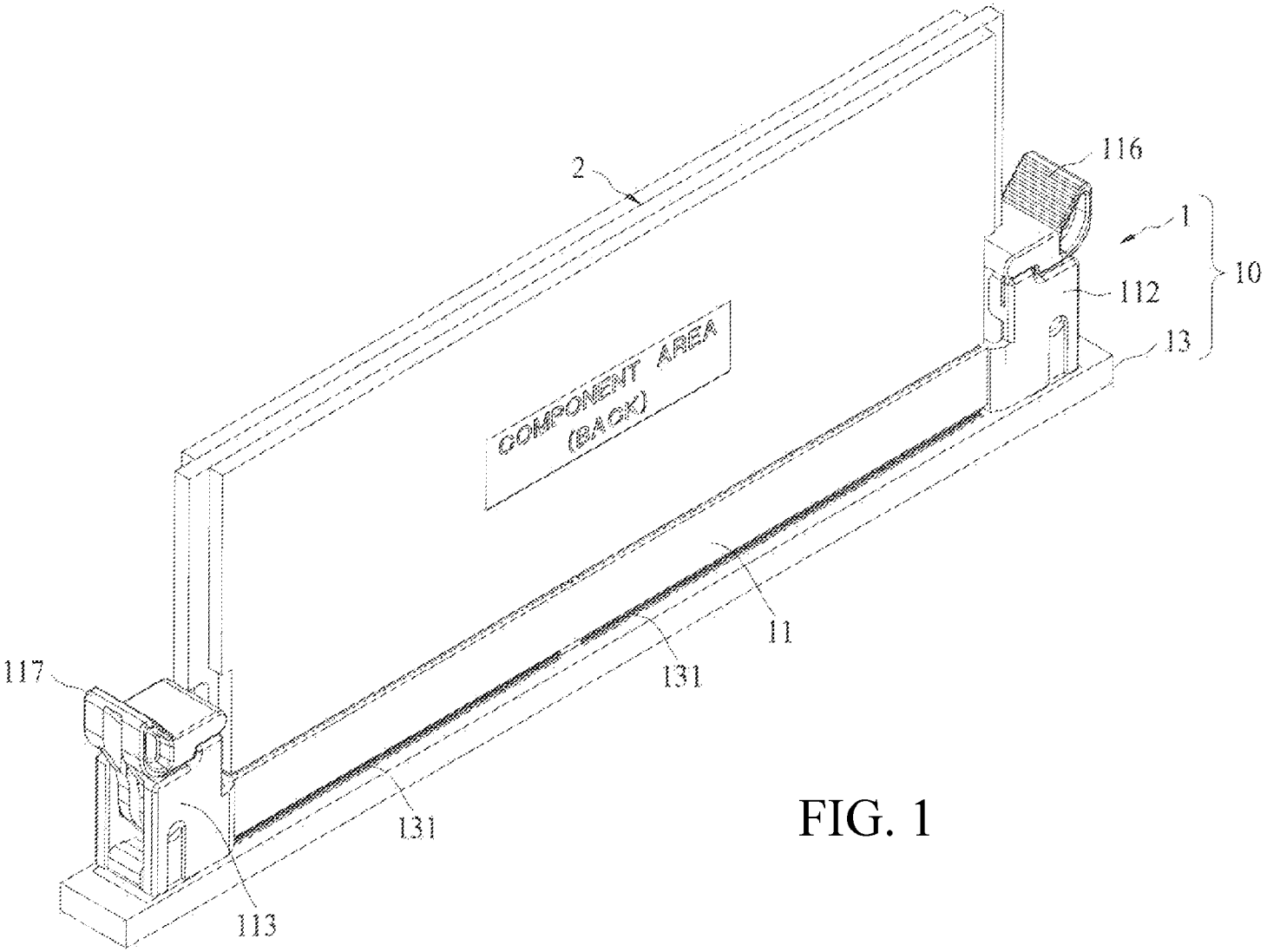
FIG. 1 is a perspective view of a first embodiment of a card edge connector assembly.

FIG. 1 is a perspective view of a card edge connector assembly 10 in a first embodiment. The card edge connector assembly 10 comprises a card edge connector 1 and a circuit board 13, an electronic card 2 is inserted into the card edge connector 1, and the card edge connector 1 is provided on/soldered on the circuit board 13.

Figure 2:
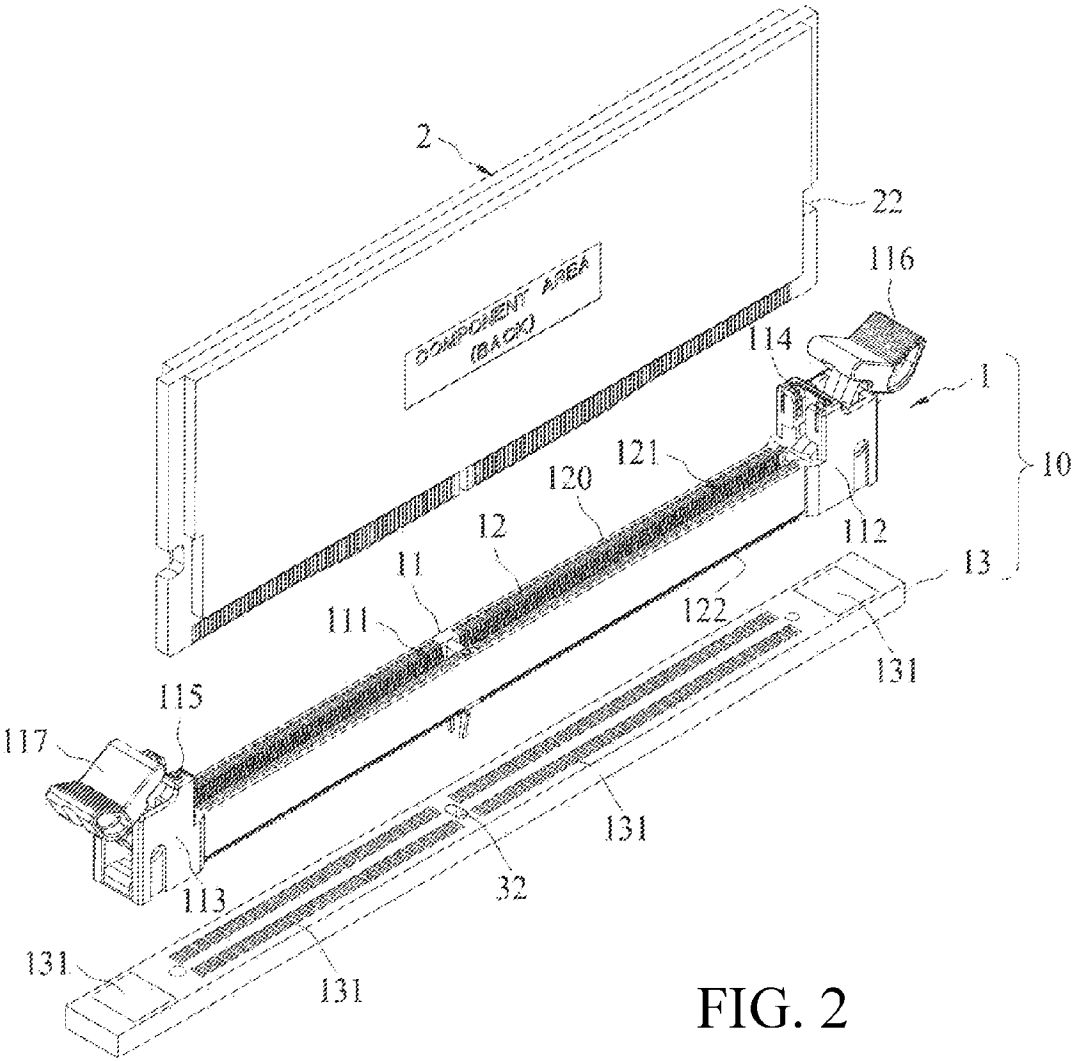
FIG. 2 is an exploded perspective view of the card edge connector assembly depicted in FIG. 1.
Figure 6:
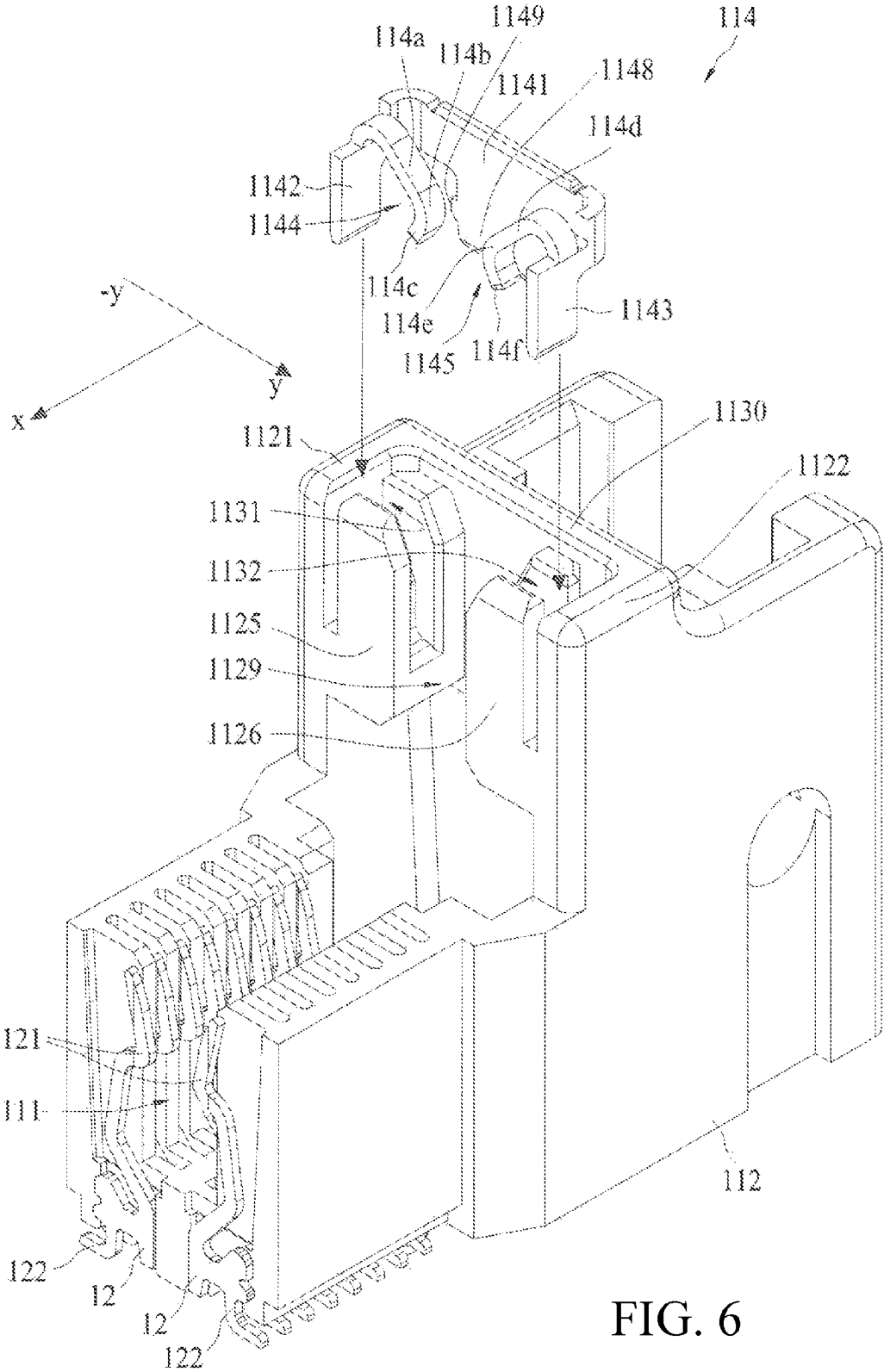
FIG. 6 is an exploded perspective view of a first metal strengthening member and the first tower in the first embodiment.

FIG. 2 is an exploded perspective view of the card edge connector assembly 10 in the first embodiment. The card edge connector 1 comprises an insulating body 11 and a plurality of terminals 12. The circuit board 13 comprises a plurality of soldering points 131 respectively coupled to the plurality of terminals 12 of the card edge connector 1. The insulating body 11 may be elongate in shape; specifically, the insulating body 11 comprises a card slot 111, a first tower 112 and a second tower 113. The card slot 111 may be elongate in shape, the electronic card 2, such as (but not limited to) a dual inline memory module, may be inserted into the card slot 111. The insulating body 11 may comprises two opposite ends, here the card slot 111 extends between the two opposite ends. Referring to FIG. 6 together, each of the plurality of terminals 12 comprises a contact portion 121 and a tail portion 122. Each tail portion 122*a* of the plurality of terminals 12 may be correspondingly soldered to one soldering point 131 of the plurality of soldering points 131 on the circuit board 13, and each contact portion 121 of the plurality of terminals 12 may at least partially protrude into the card slot 111.

Figure 3:
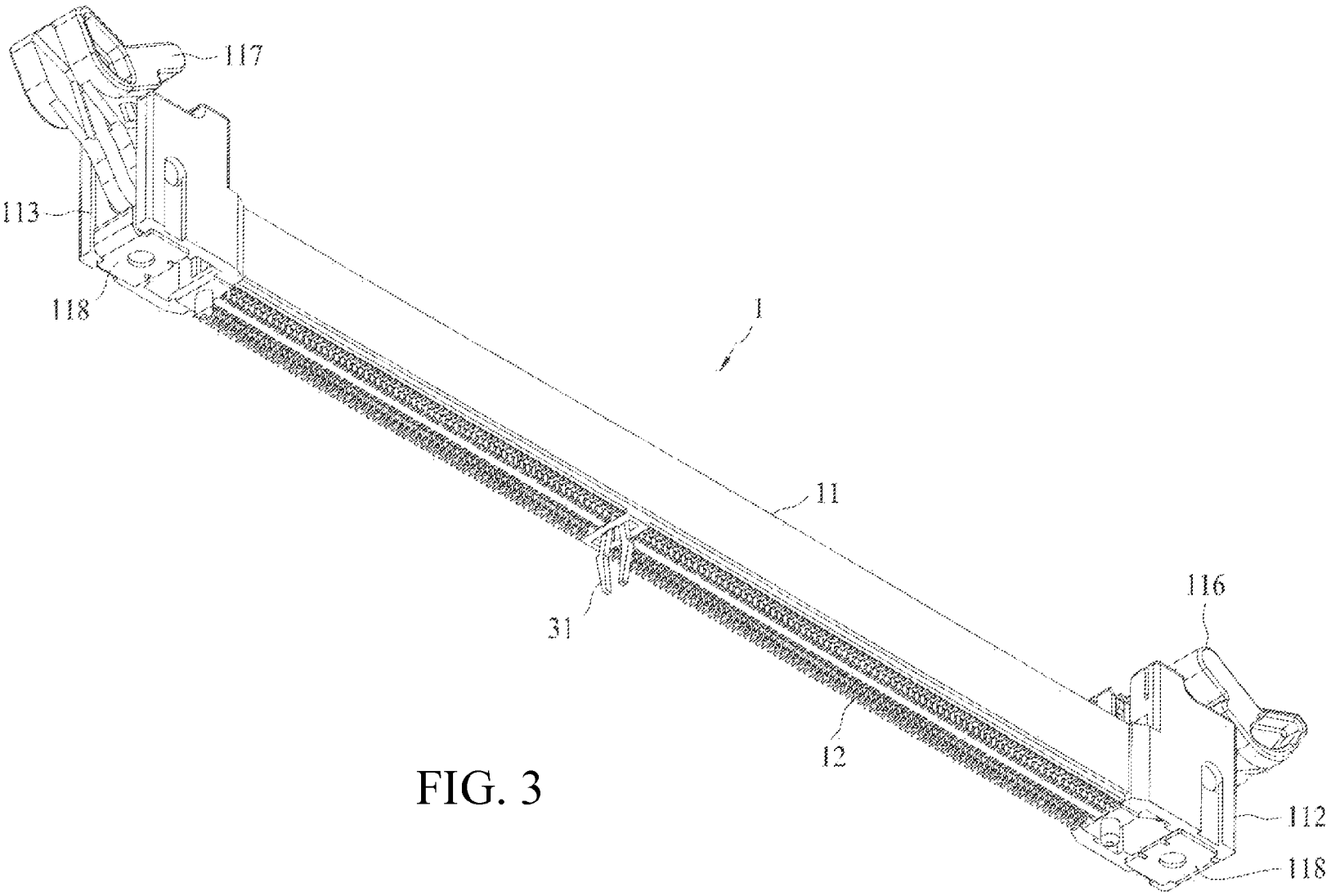
FIG. 3 is a perspective view of the card edge connector in the first embodiment.
Figure 4:
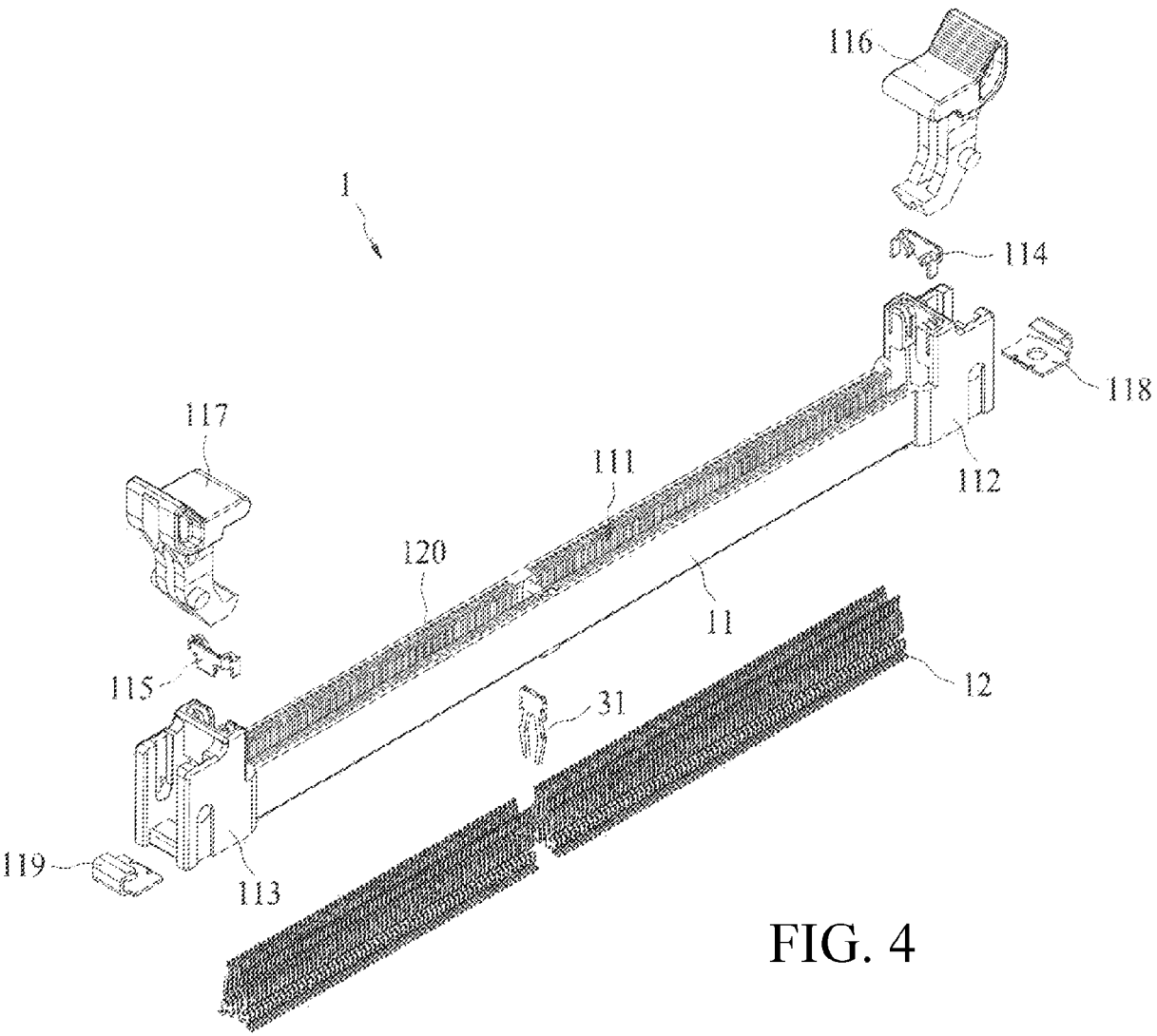
FIG. 4 is an exploded perspective view of the card edge connector in the first embodiment.

FIG. 3 is a perspective view of the card edge connector 1 in the first embodiment. FIG. 4 is an exploded perspective view of the card edge connector 1 in the first embodiment. Moreover, the card edge connector 1 further comprises a first metal strengthening member 114, a second metal strengthening member 115, a first latching-ejecting member 116 and a second latching-ejecting member 117, all of them are provided to the insulating body 11. The first tower 112, the first metal strengthening member 114 and the first latching-ejecting member 116 are provided to one end of the card slot 111, and the second tower 113, the second metal strengthening member 115 and the second latching-ejecting member 117 are provided on another end of the card slot 111. Moreover, the insulating body 11 further comprises a mating face 120, the card slot 111 is formed at the mating face 120, and the first tower 112 and the second tower 113 may protrude relative to the mating face 120.

The card edge connector 1 further comprises a board locking member 31, the board locking member 31 is mounted under the insulating body 11. The board locking member 31 may be latched into a latching hole 32 of the circuit board 13 (see FIG. 2), so that the card edge connector 1 may be fixed onto the circuit board 13. Specifically, the plurality of terminals 12 are arranged along the card slot 111, and are fixed to the insulating body 11.

The card edge connector 1 further comprises a first fitting nail 118 and a second fitting nail 119. The first fitting nail 118 may has a bottom soldering surface to be soldered on the circuit board 13. For the sake of conciseness, hereinafter the first tower 112, the first metal strengthening member 114, the first latching-ejecting member 116 and the first fitting nail 118 and components of them are described, but the second tower 113, the second metal strengthening member 115, the second latching-ejecting member 117 and the second fitting nail 119 and components of them are similar in structure so that detailed description is omitted herein.

Figure 5:
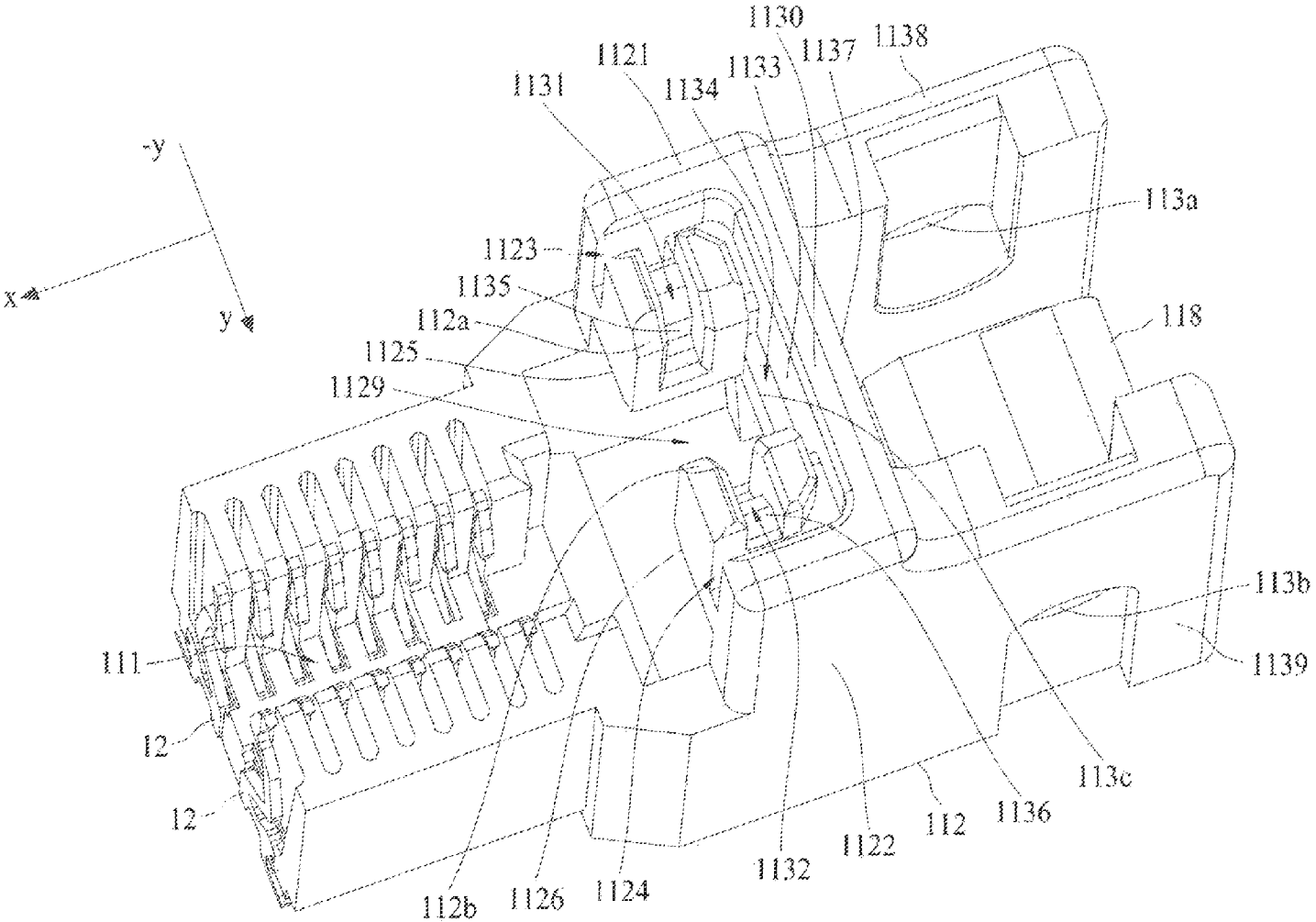
FIG. 5 is a partially enlarged view of a first tower and a first fitting nail in the first embodiment.

FIG. 5 is a partially enlarged view of the first tower 112 and the first fitting nail 118 in the first embodiment with a part of the card slot 111 and some terminals 12 illustrated. The card slot 111 extends along a first (that is the X axis in FIG. 5). The first tower 112 comprises a first side wall 1121 and a second side wall 1122 that both extend in a generally parallel first direction (e.g., along the x direction in FIG. 5). The card slot extends along the same first direction and is between the first side wall 1121 and the second side wall 1122. The first side wall 1121 and the second side wall 1122 are thus on opposing sides of the card slot. A connecting wall 1130 connecting the first side wall 1121 and the second side wall 1122, and the first metal strengthening member 114 is mounted along an inner side of the connecting wall 1130.

The first tower 112 further comprises a first guiding wall 1125 that extends transversely from the first side wall and a second guiding wall 1126 that extends transversely from the second side wall. The first and second guiding walls 1125, 1126 thus extend toward each other along a second direction (e.g., along a y axis in FIG. 5). A first mounting groove 1123 extends along the first direction (e.g., the x axis) and so extends in the same direction as the first side wall 1121 and extends through the first guiding wall 1125. A second mounting groove 1124 extending generally parallel to the first mounting groove and extends in the same direction as the second side wall 1122 and extends through the second guiding wall 1126.

As illustrated, therefore, the first tower 112 comprises the first side wall 1121 and the second side wall 1122 which extend along the first direction, and the first guiding wall 1125 and the second guiding wall 1126 are generally perpendicular to the first side wall 1121 and the second side wall 1122. As can be seen from FIG. 5, a guiding groove 1129 is provided between the first guiding wall 1125 and the second the second guiding wall 1126 and the guiding groove 1129 is aligned with the card slot 111 so as to guide the electronic card 2 into the card slot 111.

Referring to FIG. 5 again, a first receiving groove 1131 is formed in a middle of the first guiding wall 1125 is grooved and a second receiving groove 1132 is formed in a middle of the second guiding wall 1126. A third mounting groove 1134 is formed among an inside surface 1133 of the connecting wall 1130 between the first guiding wall 1125 and the second guiding wall 1126. Moreover, the first tower 112 further comprises a first block body 1135 and a second block body 1136. The first block body 1135 is provided at a bottom of the first receiving groove 1131 of the first guiding wall 1125, and the second block body 1136 is provided at a bottom of the second receiving groove 1132 of the second guiding wall 1126.

In the embodiment as shown in FIG. 5, the first tower 112 is an integrally formed configuration, and the guiding groove 1129, the first mounting groove 1123, the second mounting groove 1124, the first receiving groove 1131, the second receiving groove 1132 and the third mounting groove 1133 are communicated with each other. In the first embodiment, the first mounting groove 1123, the second mounting groove 1124, the first receiving groove 1131, the second receiving groove 1132 and the third mounting groove 1133 of the first tower 112 are used to mount the first metal strengthening member 114.

As shown in FIG. 5, the first guiding wall 1125 is provided with a first guiding surface 112*a* obliquely extending toward the guiding groove 1129 at a position close to the guiding groove 1129, the second guiding wall 1126 is provided with a second guiding surface 112*b* obliquely extending toward the guiding groove 1129 at a position close to the guiding groove 1129. When the electronic card 2 slightly offsets the guiding groove 1129 in position during insertion, the first guiding surface 112*a* and the second guiding surface 112*b* help guide the electronic card 2 toward the guiding groove 1129 so as to allow the electronic card 2 to be directed in a proper orientation for insertion into the guiding groove 1129. Because the first guiding wall 1125 and the second guiding wall 1126 are grooved to respectively form the first receiving groove 1131 and the second receiving groove 1132, the first guiding surface 112*a* of the first guiding wall 1125 is divided into two parts by the first receiving groove 1131, and the second guiding surface 112*b* of the second guiding wall 1126 is divided into two parts by the second receiving groove 1132.

FIG. 6 is an exploded perspective view of the first metal strengthening member 114 and the first tower 112 in the first embodiment. For the sake of explaining technical features of them, FIG. 6 further illustrates a part of the card slot 111 and some terminals 12. The first metal strengthening member 114 comprises a base portion 1141, a first side portion 1142, a second side portion 1143, a first elastic arm 1144 and a second elastic arm 1145. The first side portion 1142 and the second side portion 1143 extend respectively from two sides of the base portion 1141 toward the inside direction (the positive x direction). The first elastic arm 1144 extends from the first side portion 1142 toward a y direction, and the second elastic arm 1145 extends from the second side portion 1143 toward a −y direction, the y direction and the −y direction are perpendicular to the inside direction (the positive x direction), that is, the first elastic arm 1144 and the second elastic arm 1145 extend respectively from the first side portion 1142 and the second side portion 1143 toward the guiding groove 1129. Specifically, the first elastic arm 1144 extends transversely from the first side portion 1142 toward the positive y direction, and the second elastic arm 1145 extends transversely from the second side portion 1143 toward the negative y direction. When the first metal strengthening member 114 is mounted to the first tower 112, the first elastic arm 1144 and the second elastic arm 1145 are respectively disposed in the first receiving groove 1131 and the second receiving groove 1132.

Referring to FIG. 6 again, the first elastic arm 1144 comprises a first oblique surface 114*a*, a first clamping portion 114*b* and a first distal end 114*c*. The first elastic arm 1144 firstly extends upwardly from an upper end of the first side portion 1142, and then the first oblique surface 114*a* will extend obliquely, i.e. inwardly and downwardly, at a preset angle away from the first side portion 1142, that is, the first oblique surface 114*a* will extends from the upper end of the first side portion 1142 toward the guiding groove 1129 (toward the y direction). After extending by a certain distance, the first elastic arm 1144 will extends toward the first side portion 1142 (toward the −y direction), so as to form the first clamping portion 114*b* and the first distal end 114*c*. The certain distance will allow that: when the first metal strengthening member 114 is mounted to the first tower 112, the first elastic arm 1144 is disposed in the first receiving groove 1131 and the first clamping portion 114*b* protrudes transversely relative to the first guiding wall 1125 and protrudes into the guiding groove 1129.

Similarly, the second elastic arm 1145 comprises a second oblique surface 114*d*, a second clamping portion 114*e* and a second distal end 114*f*. The second elastic arm 1145 firstly extends upwardly from an upper end of the second side portion 1143, and then the second oblique surface 114*d* will extend obliquely, i.e. inwardly and downwardly, at a preset angle away from the second side portion 1143, that is, the second oblique surface 114*d* will extend from the upper end of the second side portion 1143 toward the guiding groove 1129 (toward the −y direction). After extending by a certain distance, the second elastic arm 1145 will extend toward the second side portion 1143 (toward the y direction), so as to form the second clamping portion 114*e* and the second distal end 114*f*. The certain distance will allow that: when the first metal strengthening member 114 is mounted to the first tower 112, the second elastic arm 1145 is disposed in the second receiving groove 1132 and the second clamping portion 114*e* protrudes transversely relative to the second guiding wall 1126 and protrudes into the guiding groove 1129.

Figure 7:
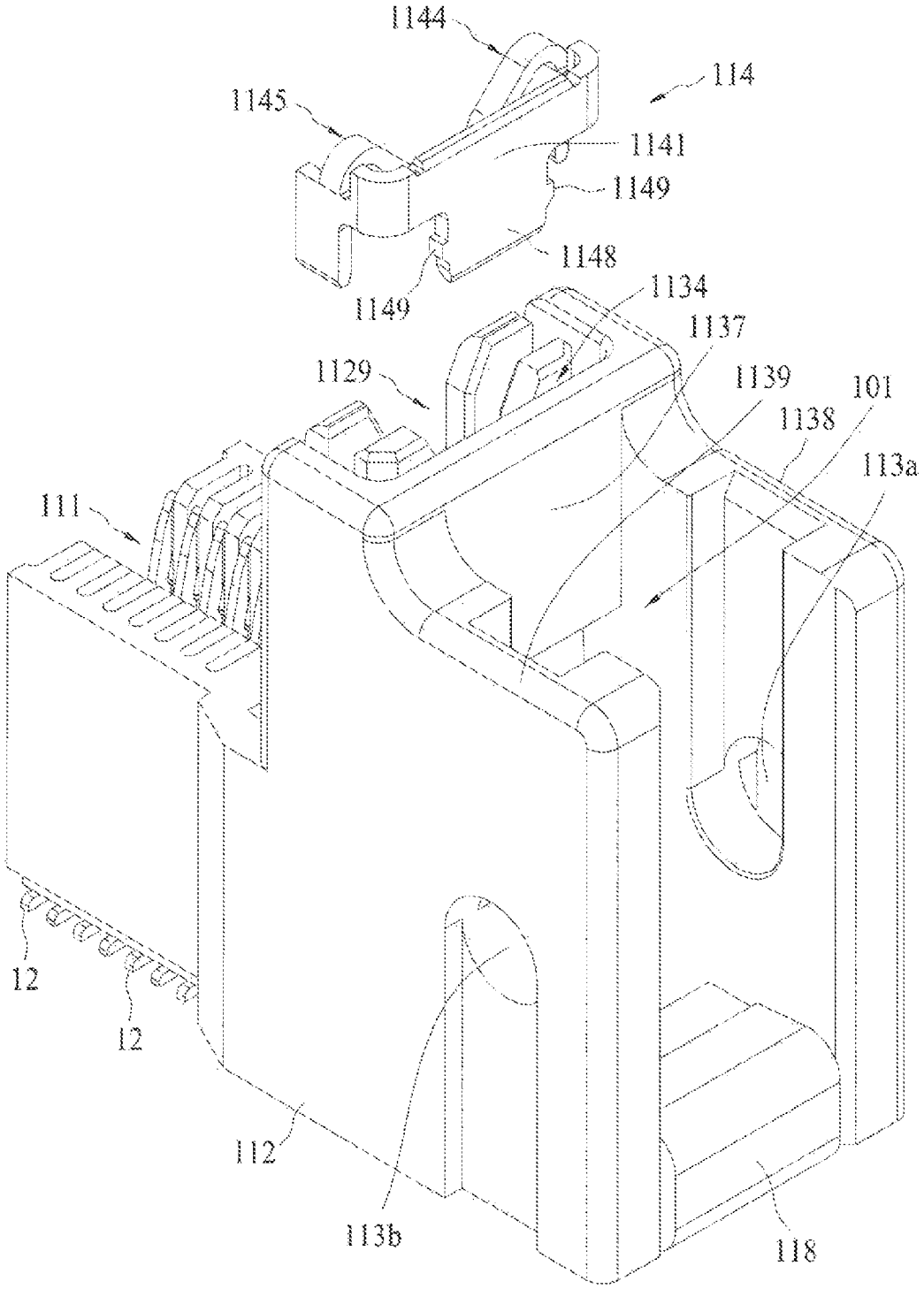
FIG. 7 is another exploded perspective view of the first metal strengthening member and the first tower in the first embodiment.

FIG. 7 is another exploded perspective view of the first metal strengthening member 114 and the first tower 112 in the first embodiment. A latching-ejecting member mounting portion 101 is further provided at an outer side of the first tower 112 (that is an outer side of an outside surface 1137 of the connecting wall 1130, the outside surface 1137 is opposite to the inside surface 1133). The first latching-ejecting member 116 is pivoted to the latching-ejecting member mounting portion 101. In a word, the latching-ejecting member mounting portion 101 is correspondingly formed by a third side wall 1138 and a fourth side wall 1139 and the first fitting nail 118. The third side wall 1138 and the fourth side wall 1139 respectively have a first pivoting hole 113*a* and a second pivoting hole 113*b*. But the first fitting nail 118 is positioned at a lower part of the latching-ejecting member mounting portion 101, that is, under the first latching-ejecting member 116.

As can be appreciated from FIG. 7, the base portion 1141 of the first metal strengthening member 114 further comprises a fixed portion 1148 at a lower part of the base portion 1141. The fixed portion 1148 is fixed in the third mounting groove 1134 of the first tower 112. Furthermore, each of two sides of the fixed portion 1148 has an interference protrusion 1149 fixed in a recessed portion 113*c* of the third mounting groove 1134. When the first metal strengthening member 114 is mounted in the third mounting groove 1134 of the first tower 112, the interference protrusion 1149 and an inner wall of the recessed portion 113*c* of the third mounting groove 1134 are interference fitted, so as to allow the first metal strengthening member 114 to be fixed.

Figure 8:
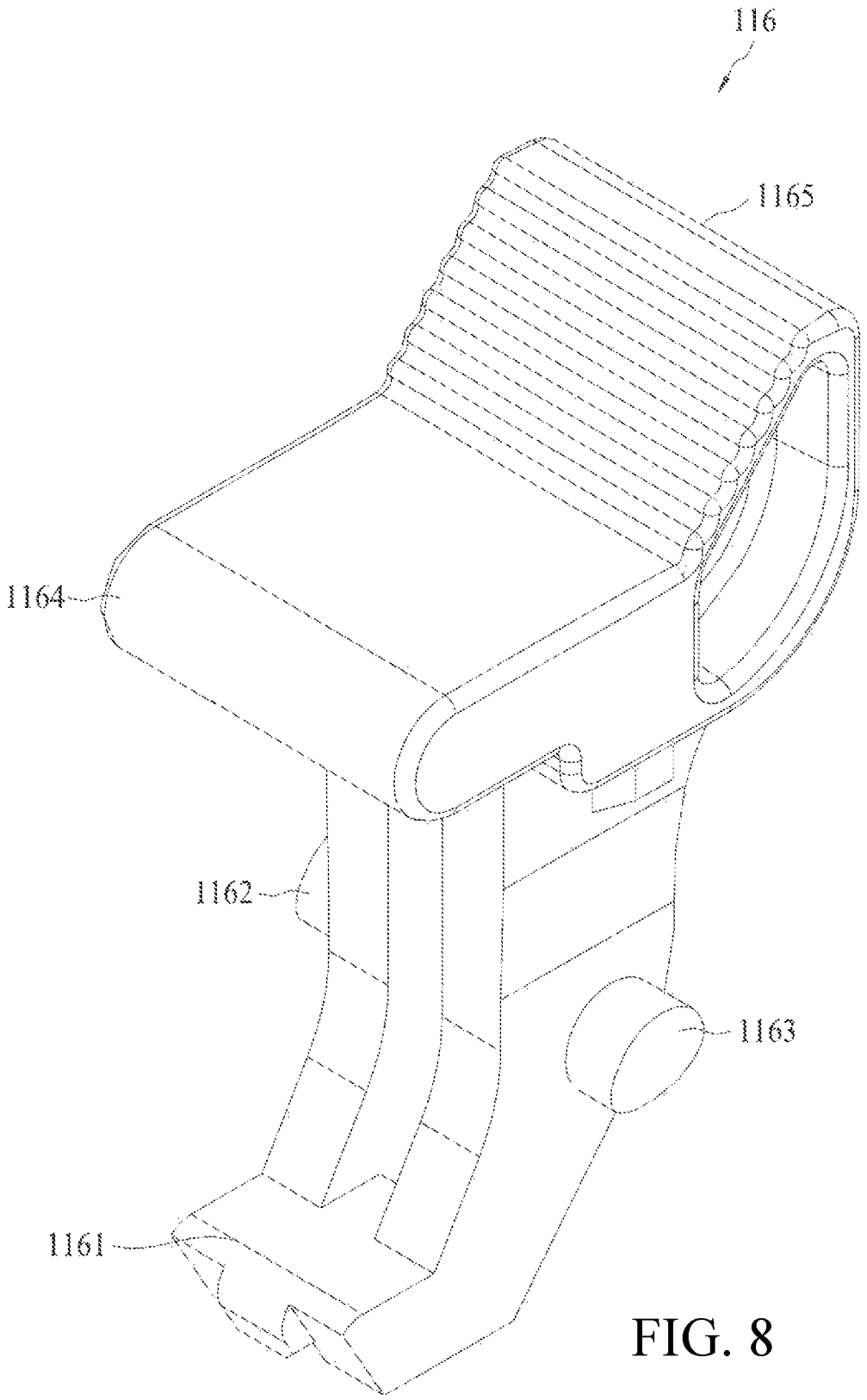
FIG. 8 is a perspective view of a first latching-ejecting member in the first embodiment.

FIG. 8 is a perspective view of the first latching-ejecting member 116 in the first embodiment. The first latching-ejecting member 116 comprises an ejecting portion 1161, a first pivoting shaft 1162, a second pivoting shaft 1163, a latching portion 1164 and a top portion 1165. The first latching-ejecting member 116 is mounted between the third side wall 1138 and the fourth side wall 1139 which are at a rear side of the first tower 112. In a word, the first pivoting shaft 1162 and the second pivoting shaft 1163 of the first latching-ejecting member 116 will be respectively pivoted into the first pivoting hole 113*a* and the second pivoting hole 113*b* (see FIG. 7).

Figure 9:
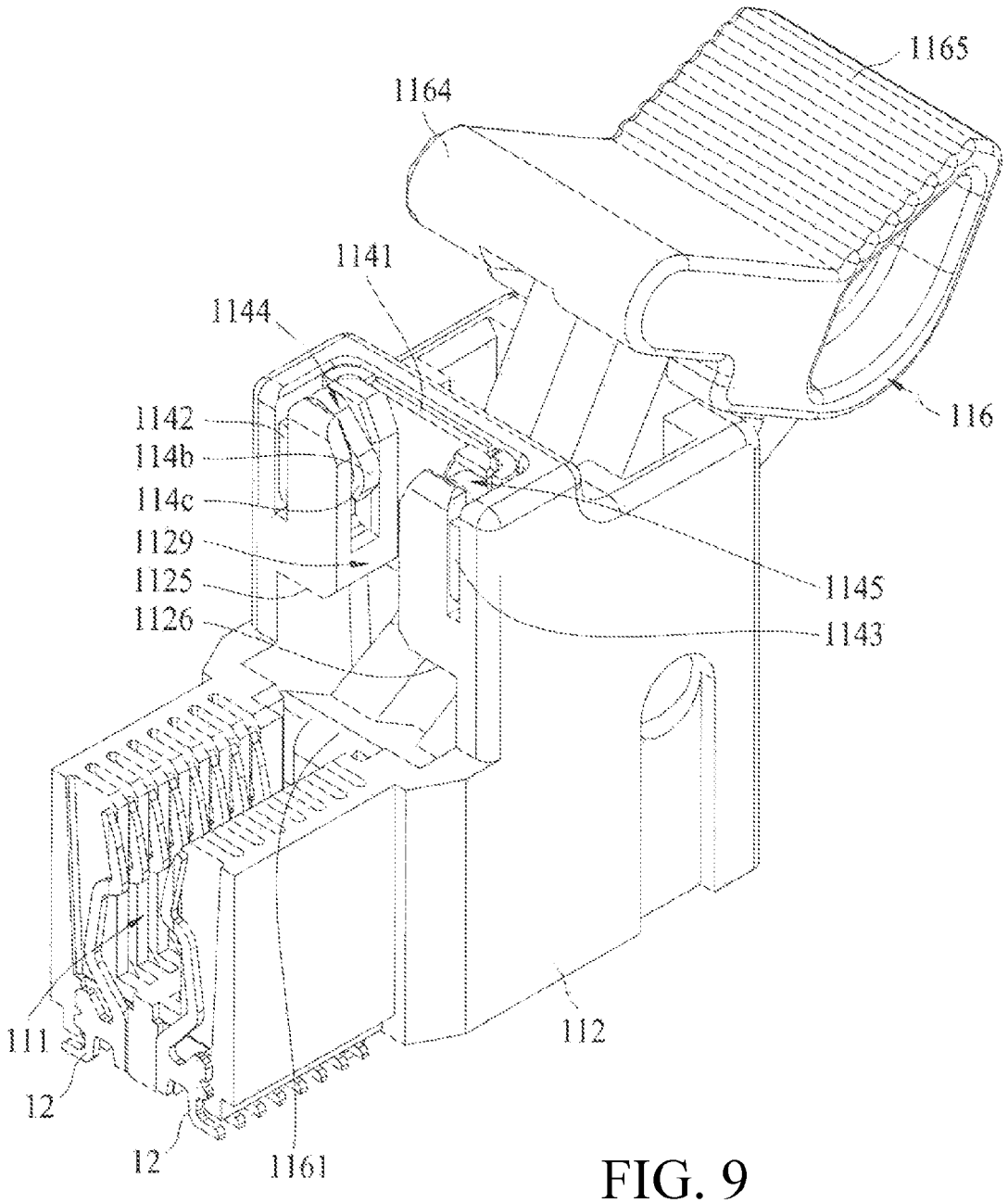
FIG. 9 is a view illustrating that the first metal strengthening member and the first latching-ejecting member are mounted to the first tower in the first embodiment.

FIG. 9 is a perspective view illustrating that the first metal strengthening member 114 and the first latching-ejecting member 116 are mounted to the first tower 112 in the first embodiment. FIG. 9 further illustrates a part of the card slot 111 and some terminals 12. The base portion 1141, the first side portion 1142, the second side portion 1143, the first elastic arm 1144 and the second elastic arm 1145 of the first metal strengthening member 114 are respectively inserted into the third mounting groove 1134, the first mounting groove 1123, the second mounting groove 1124, the first receiving groove 1131 and the second receiving groove 1132 of the first tower 112. The first elastic arm 1144 is close to a side wall the first guiding wall 1125, that is, two sides of the first elastic arm 1144 are close to two inside surfaces of the first receiving groove 1131 respectively. The second elastic arm 1145 is close to a side wall of the second guiding wall 1126, that is, two sides of the second elastic arm 1145 are close to two inside surfaces of the second receiving groove 1132 respectively. The first elastic arm 1144 extends transversely beyond a covering range off the side wall of the first guiding wall 1125 via the first receiving groove 1131 and extends into the guiding groove 1129, the second elastic arm 1145 extends transversely beyond a covering range of the side wall of the second guiding wall 1126 via the second receiving groove 1132 and extends into the guiding groove 1129. It should be noted that, the above so-called "close to" may refer to a case that they contact each other or a case that they do not contact each other.

Moreover, when the first latching-ejecting member 116 is mounted to the first tower 112, the ejecting portion 1161 of the first latching-ejecting member 116 is generally positioned under the guiding groove 1129. However, when the first latching-ejecting member 116*a* is in an ejecting status according to rotation of the first pivoting shaft 1162 and the second pivoting shaft 1163 (as shown in FIG. 9), the ejecting portion 1161 of the first latching-ejecting member 116 will slightly move upwardly so as to eject the electronic card 2 out of the card edge connector 1.

Figure 10:
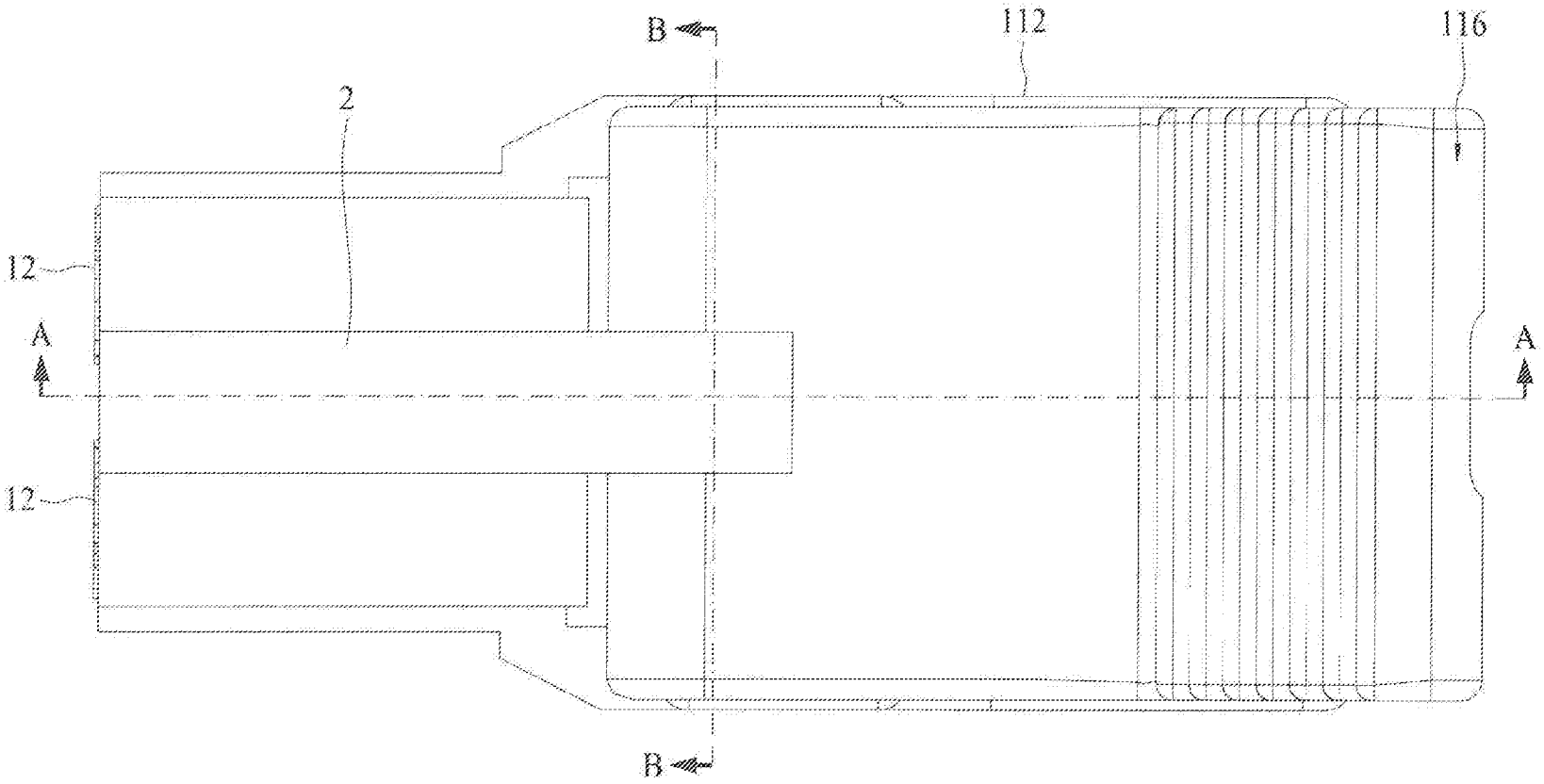
FIG. 10 is a partial top view illustrating that an electronic card is inserted into a card slot of the card edge connector in the first embodiment.

FIG. 10 is a partial top view illustrating that the electronic card 2 is inserted into the card slot 111 of the card edge connector 1 in the first embodiment, and illustrating a part of the electronic card 2, a part of the insulating body 11, some terminals 12, the first latching-ejecting member 116 and the first tower 112. In addition, the top view of FIG. 10 also illustrates two cross sectional lines, that is, a line A-A and a line B-B.

Figure 11:
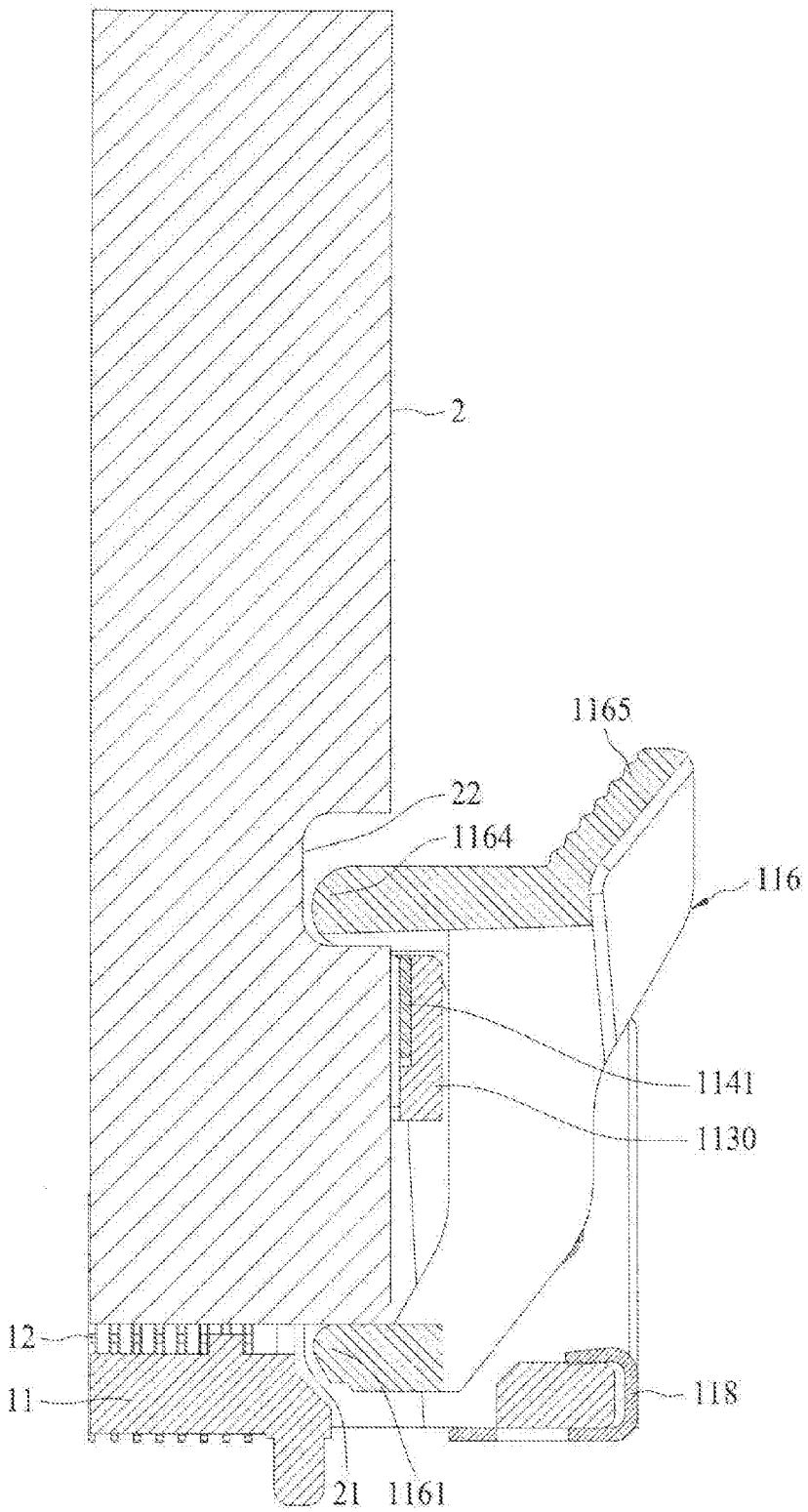
FIG. 11 is a cross sectional view taken along a line A-A of FIG. 10.

FIG. 11 is a cross sectional view taken along the line A-A of FIG. 10. When the electronic card 2 is inserted into the card slot 111, a lower edge of the electronic card 2 may press against the ejecting portion 1161, so as to allow the first latching-ejecting member 116 to rotate around the first pivoting shaft 1162 and the second pivoting shaft 1163, and in turn allow the first latching-ejecting member 116 to be upright and allow the latching portion 1164 of the first latching-ejecting member 116 to be latched into a card notch 22 of the electronic card 2, so as to lock the electronic card 2 on the card edge connector 1. Contrarily, when the top portion 1165 of the first latching-ejecting member 116 is pressed down, the first latching-ejecting member 116 will also rotate around the first pivoting shaft 1162 and the second pivoting shaft 1163, the ejecting portion 1161 of the first latching-ejecting member 116 will push upwardly the lower edge of the electronic card 2 inserted into the card slot 111, so as to eject the electronic card 2 out of the card edge connector 1.

Figure 12:
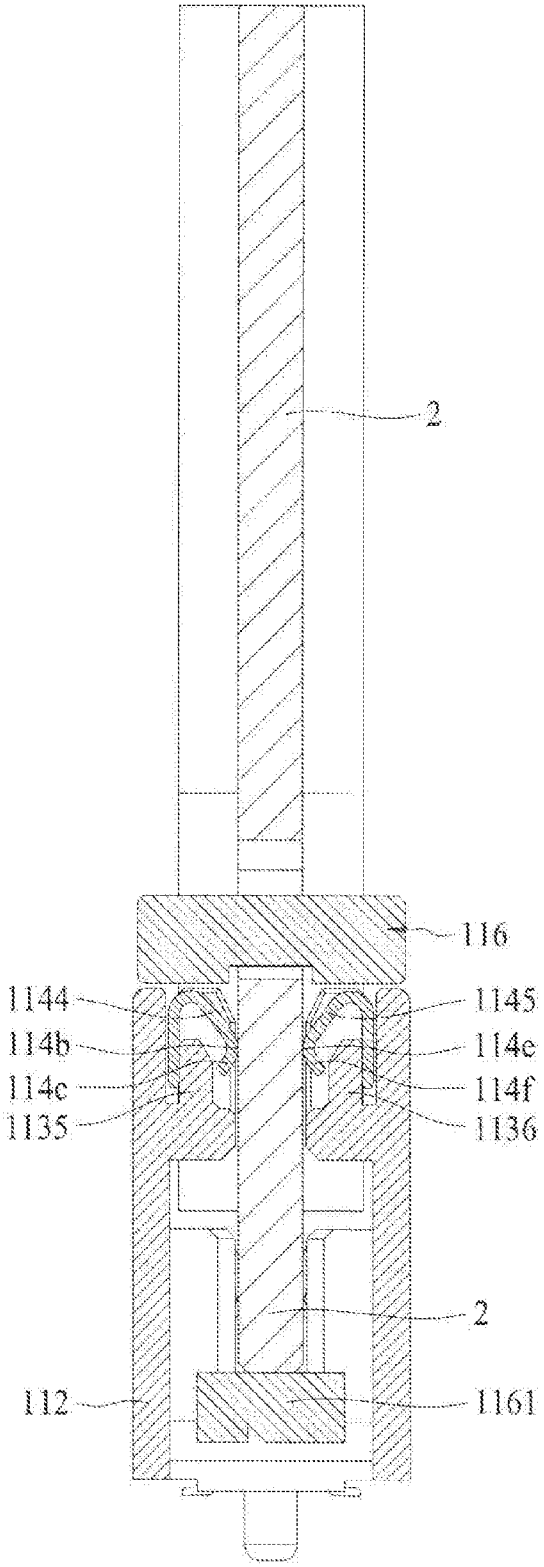
FIG. 12 is a cross sectional view taken along a line B-B of FIG. 10.

FIG. 12 is a cross sectional view taken along a line B-B of FIG. 10. When the electronic card 2 is inserted into the card slot 111, the first clamping portion 114*b* of the first elastic arm 1144 and the second clamping portion 114*e* of the second elastic arm 1145 will respectively clamp the electronic card 2 from two sides of a side edge portion of the electronic card 2, so as to allow the inserted the electronic card 2 to be more stable and better in anti-vibration and anti-sway. Moreover, in an implementing manner, that is, when the electronic card 2 is inserted into the card slot 111, the first distal end 114*c* of the first elastic arm 1144 does not contact the first block body 1135 of the first tower 112, and the second distal end 114*f* of the second elastic arm 1145 also does not contact the second block body 1136 of the first tower 112. A benefit of providing the first block body 1135 and the second block body 1136 is to prevent the first elastic arm 1144 or the second elastic arm 1145 from being damaged due to excessive squeeze when a foreign matter is inserted into the card slot 111. For example, if a slender foreign matter is accidentally inserted into the first receiving groove 1131 to deflect the first elastic arm 1144, the first block body 1135 will stop the first distal end 114*c* of the first elastic arm 1144, so as not to allow the first elastic arm 1144 to be further deflected and in turn deformed. Moreover, in a varied implementing manner, when the electronic card 2 is inserted into the card slot 111, the first distal end 114*c* of the first elastic arm 1144 may contact the first block body 1135 of the first tower 112, and the second distal end 114*f* of the second elastic arm 1145 may also contact the second block body 1136 of the first tower 112, so that a clamping force will be increased.

Figure 13:
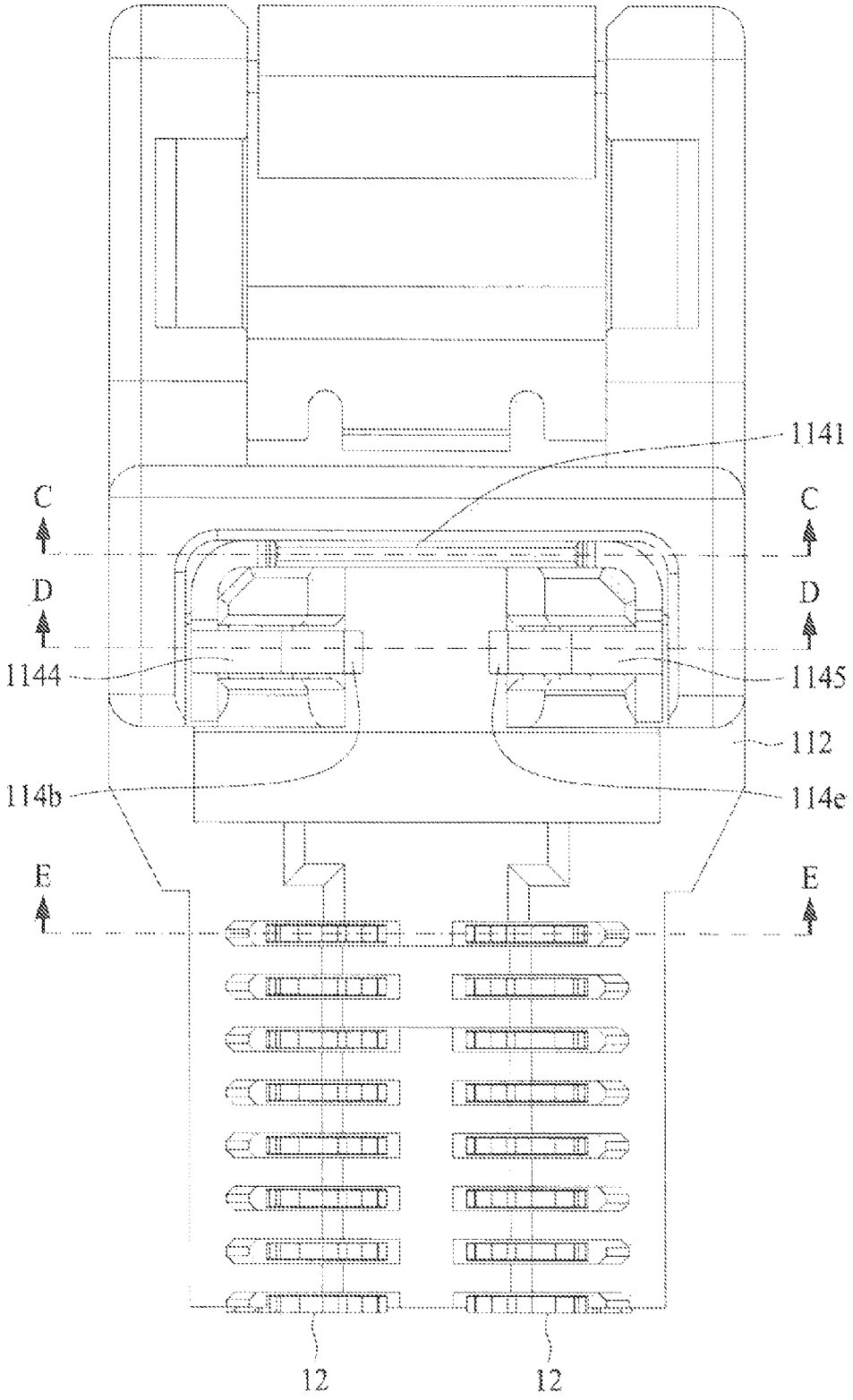
FIG. 13 is a partial top view viewed after the first metal strengthening member is mounted to the first tower in the first embodiment.

FIG. 13 is a partial top view viewed after the first metal strengthening member 114 is mounted to the first tower 112 in the first embodiment (without the electronic card 2 and the first latching-ejecting member 116), and illustrating a part of the insulating body 11, some terminals 12 and the first tower 112. In addition, the top view of FIG. 13 also illustrates three cross sectional lines, that is, a line C-C, a line D-D and a line E-E.

Figure 14:
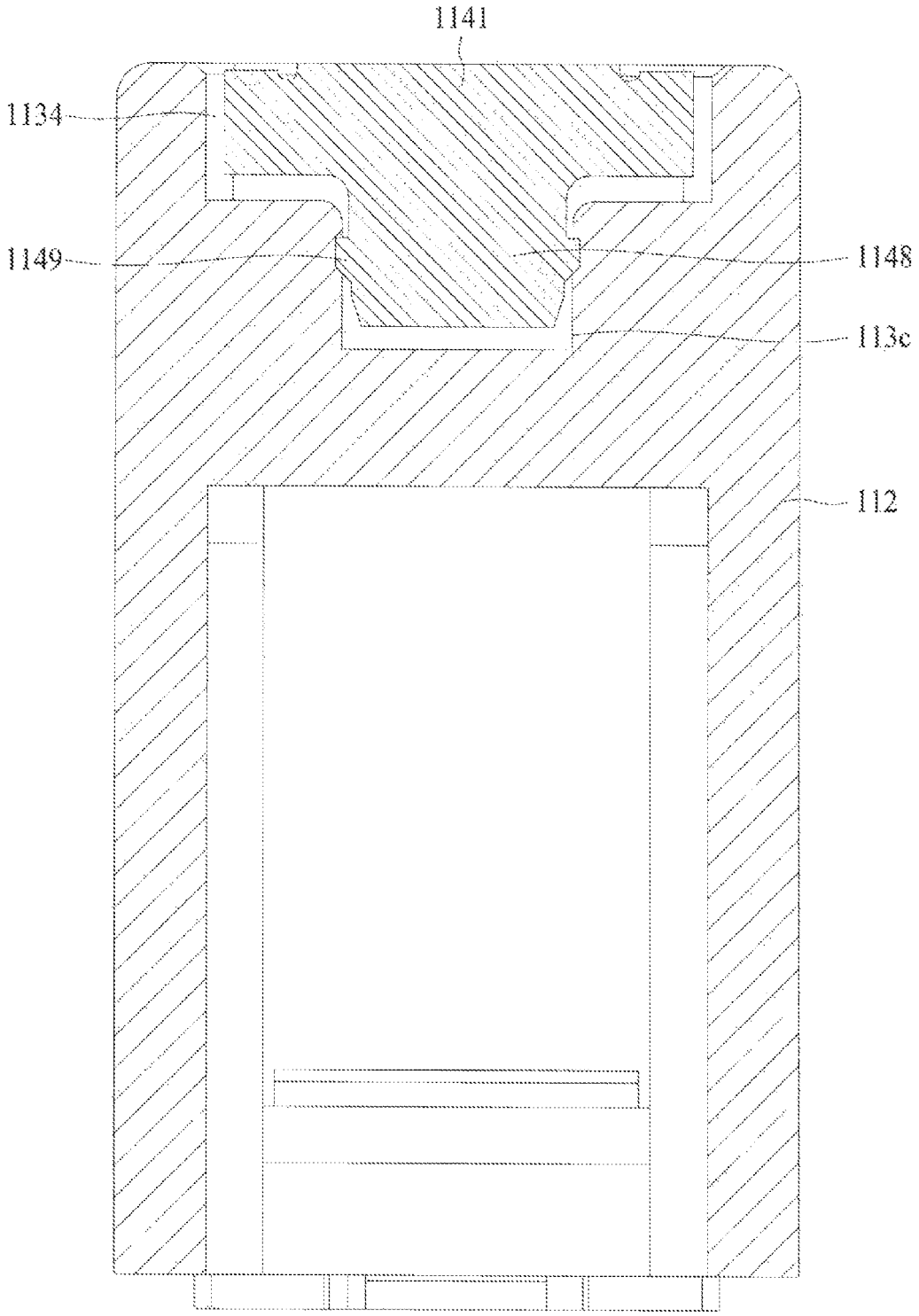
FIG. 14 is a cross sectional view taken along a line C-C of FIG. 13.

FIG. 14 is cross sectional view taken along a line C-C of FIG. 13. The base portion 1141 of the first metal strengthening member 114 is further provided with the fixed portion 1148 at the lower part of the base portion 1141. The fixed portion 1148 is fixed in the third mounting groove 1134 of the first tower 112. The base portion 1141 of the first metal strengthening member 114 has a profile which is wide at an upper part and narrow at a lower part; correspondingly, the third mounting groove 1134 also has a profile which is wide at an upper part and narrow at a lower part. In a word, the two sides of the fixed portion 1148 each have the interference protrusion 1149 fixed in the recessed portion 113*c* at the lower part of the third mounting groove 1134. When the first metal strengthening member 114 is mounted in the third mounting groove 1134 of the first tower 112, the interference protrusion 1149 and the inner wall of the recessed portion 113*c* of the third mounting groove 1134 are interference fitted, so as to allow the first metal strengthening member 114 to be fixed.

Figure 15:
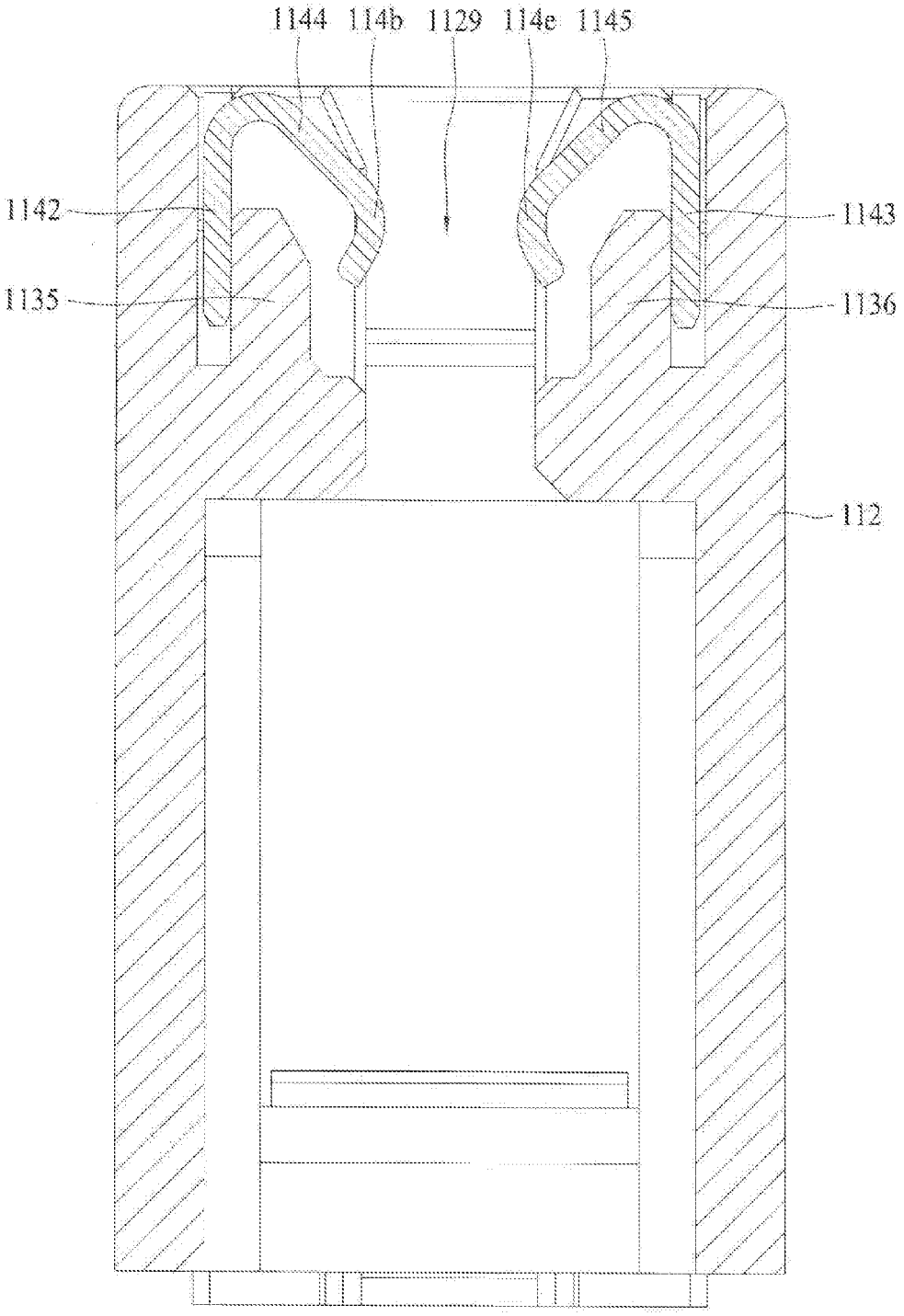
FIG. 15 is a cross sectional view taken along a line D-D of FIG. 13.
Figure 16:
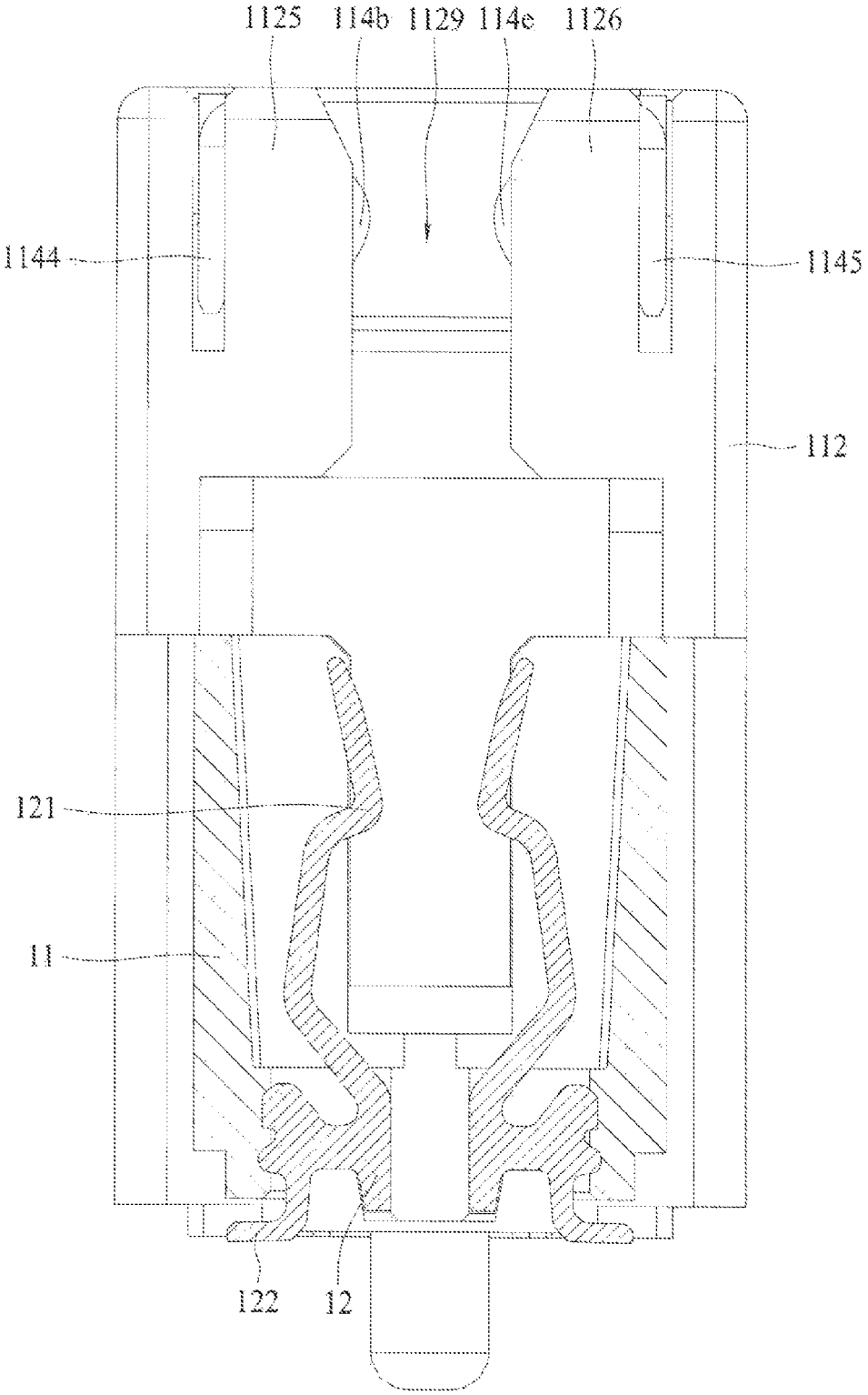
FIG. 16 is a cross sectional view taken along a line E-E of FIG. 13.

FIG. 15 is a cross sectional view taken along a line D-D of FIG. 13. FIG. 16 is a cross sectional view taken along a line E-E of FIG. 13. After the first metal strengthening member 114 is mounted to the first tower 112, most of the first elastic arm 1144 will be received in the first receiving groove 1131 of the first guiding wall 1125 and most of the second elastic arm 1145 will be received in the second receiving groove 1132 of the second guiding wall 1126, and only the first clamping portion 114*b* of the first elastic arm 1144 will protrude from the first receiving groove 1131 and protrude into the guiding groove 1129, and only the second clamping portion 114*e* of the second elastic arm 1145 will protrude from the second receiving groove 1132 and protrude into the guiding groove 1129. In the first receiving groove 1131, the first elastic arm 1144 is close to the first guiding wall 1125 and is subject to limitation by the side wall of the first receiving groove 1131, and in the second receiving groove 1132, the second elastic arm 1145 is close to the second guiding wall 1126 and is subject to limitation by the side wall of the second receiving groove 1132, therefore when the electronic card 2 is inserted downwardly into the guiding groove 1129 along the up-down direction, the first guiding wall 1125 will provide a lateral abutting force for the first elastic arm 1144 via the side wall of the first guiding wall 1125 and the second guiding wall 1126 will provide a lateral abutting force for the second elastic arm 1145 via the side wall of the second guiding wall 1126, so that the first elastic arm 1144 and the second elastic arm 1145 will not be fallen down and in turn fail in function due to slight skew caused by squeezing of the electronic card 2. In other words, providing the first guiding wall 1125 and the second guiding wall 1126 may attain a purpose of protecting the first elastic arm 1144 and the second elastic arm 1145.

Moreover, a top portion of the first elastic arm 1144 is generally identical to a top portion of the first guiding wall 1125 in height and a top portion of the second elastic arm 1145 is generally identical to a top portion of the second guiding wall 1126 in height, most of the first elastic arm 1144 will be received in the first receiving groove 1131 of the first guiding wall 1125 and most of the second elastic arm 1145 is will be received in the second receiving groove 1132 of the second guiding wall 1126, and only the first clamping portion 114*b* and the second clamping portion 114*e* will protrude into the guiding groove 1129, therefore when the electronic card 2 is inserted downwardly into the guiding groove 1129 along the up-down direction, the lower edge of the electronic card 2 may only contact the first guiding wall 1125 and the second guiding wall 1126 and the first clamping portion 114*b* in the guiding groove 1129 and the second clamping portion 114*e* in the guiding groove 1129, and will not contact the top portion and other part of the first elastic arm 1144 and the top portion and other part of the second elastic arm 1145, therefore the first elastic arm 1144 and the second elastic arm 1145 will not be crushed due to collision or will not be deformed to snap into the guiding groove 1129 due to collision. It should be noted that, when the electronic card 2 is inserted into the card slot 111, besides the first elastic arm 1144 and the second elastic arm 1145 elastically clamp the electronic card 2 from two sides of the electronic card 2, and the electronic card 2 will also be electrically connected to the plurality of terminals 12. It should be noted that, within a range of elasticity, the top portion of the first elastic arm 1144 may be slightly higher than the top portion of the first guiding wall 1125 and the top portion of the second elastic arm 1145 may be slightly higher than the top portion of the second guiding wall 1126, but the first guiding wall 1125 and the second guiding wall 1126 still can provide the protecting function.

Moreover, when the first metal strengthening member 114 is mounted to the first tower 112, the first block body 1135 is positioned between the first side portion 1142 and the first elastic arm 1144, and the second block body 1136 is positioned between the second side portion 1143 and the second elastic arm 1145. The first distal end 114*c* of the first elastic arm 1144 extends toward the first side portion 1142 so that the first distal end 114*c* again enters into the first receiving groove 1131, and the second distal end 114*f* of the second elastic arm 1145 extends toward the second side portion 1143 so that the second distal end 114*f* again enters into the second receiving groove 1132. When the electronic card 2 is inserted downwardly into the guiding groove 1129 along the up-down direction, the two sides of the side edge portion of the electronic card 2 will respectively push outwardly the first clamping portion 114*b* and the second clamping portion 114*e*. Therefore, the first elastic arm 1144 and the second elastic arm 1145 will generate opposite elastic forces to clamp the electronic card 2, so as to allow the inserted electronic card 2 to be more stable and better in anti-vibration and anti-sway.

The first metal strengthening member 114 is bridged between the first side wall 1121 and the second side wall 1122 of the first tower 112, therefore the first metal strengthening member 114 can help strengthen the structure strength of the first tower 112 between the first side wall 1121 and the second side wall 1122 and this may help prevent the connecting wall 1130 between the first side wall 1121 and the second side wall 1122 of the first tower 112 from being fractured during insertion of a card into the card slot 111.

It should be noted that, although the first receiving groove 1131 and the second receiving groove 1132 may be provided to respectively protect the first elastic arm 1144 and the second elastic arm 1145, the present disclosure is not limited the case that an elastic arm must be disposed in a receiving groove formed by grooving a middle part of one guiding wall. According to the method provided by the present disclosure, a guiding wall which is not grooved to form a receiving groove is enough to meet the requirement for protecting an elastic arm. Furthermore, when a metal strengthening member is mounted to a tower, as long as an elastic arm is close to or abuts against a guiding wall which is not grooved to form a receiving groove, the guiding wall which is not grooved to form a receiving groove is enough to protect the elastic arm and prevent the elastic arm from being deflected and in turn deformed.

Taking the first elastic arm 1144 of FIG. 9 as an example, if the first guiding wall 1125 of the first tower 112 is not grooved (that is, not formed with the first receiving groove 1131), as long as the first elastic arm 1144 is close to or abuts against a side wall of the first guiding wall 1125, and whether the first elastic arm 1144 is close to or abuts against a left side wall (close to a card slot 111 side) or a right side wall (close to the first latching-ejecting member 116 side) of the first guiding wall 1125, the first guiding wall 1125 is enough to protect the first elastic arm 1144 and allow the first elastic arm 1144 not to be deflected and in turn deformed. Similarly, the second elastic arm 1145 also has a similar technical feature. Therefore, preventing an elastic arm from being deformed by means of one guiding wall (which is grooved or is not grooved) also belongs to the scope.

As can be seen from above description for the first embodiment, the first elastic arm 1144 and the second elastic arm 1145 are configured to allow the first clamping portion 114*b* and the second clamping portion 114*e* to protrude into the guiding groove 1129, therefore besides the first elastic arm 1144 and the second elastic arm 1145 may allow the inserted electronic card 2 to be more stable and better in anti-vibration and anti-sway, the present disclosure further may prevent the first elastic arm 1144 and the second elastic arm 1145 from being deflected and in turn deformed by the lower edge 21 of the electronic card 2. Moreover, the first metal strengthening member 114 is bridged between the first side wall 1121 and the second side wall 1122 of the first tower 112, therefore the first metal strengthening member 114 may also strengthen a stress strength of the part of the first tower 112 between the first side wall 1121 and the second side wall 1122, so as to prevent the connecting wall 1130 from being deflected and in turn fractured by the electronic card 2.

Figure 17:
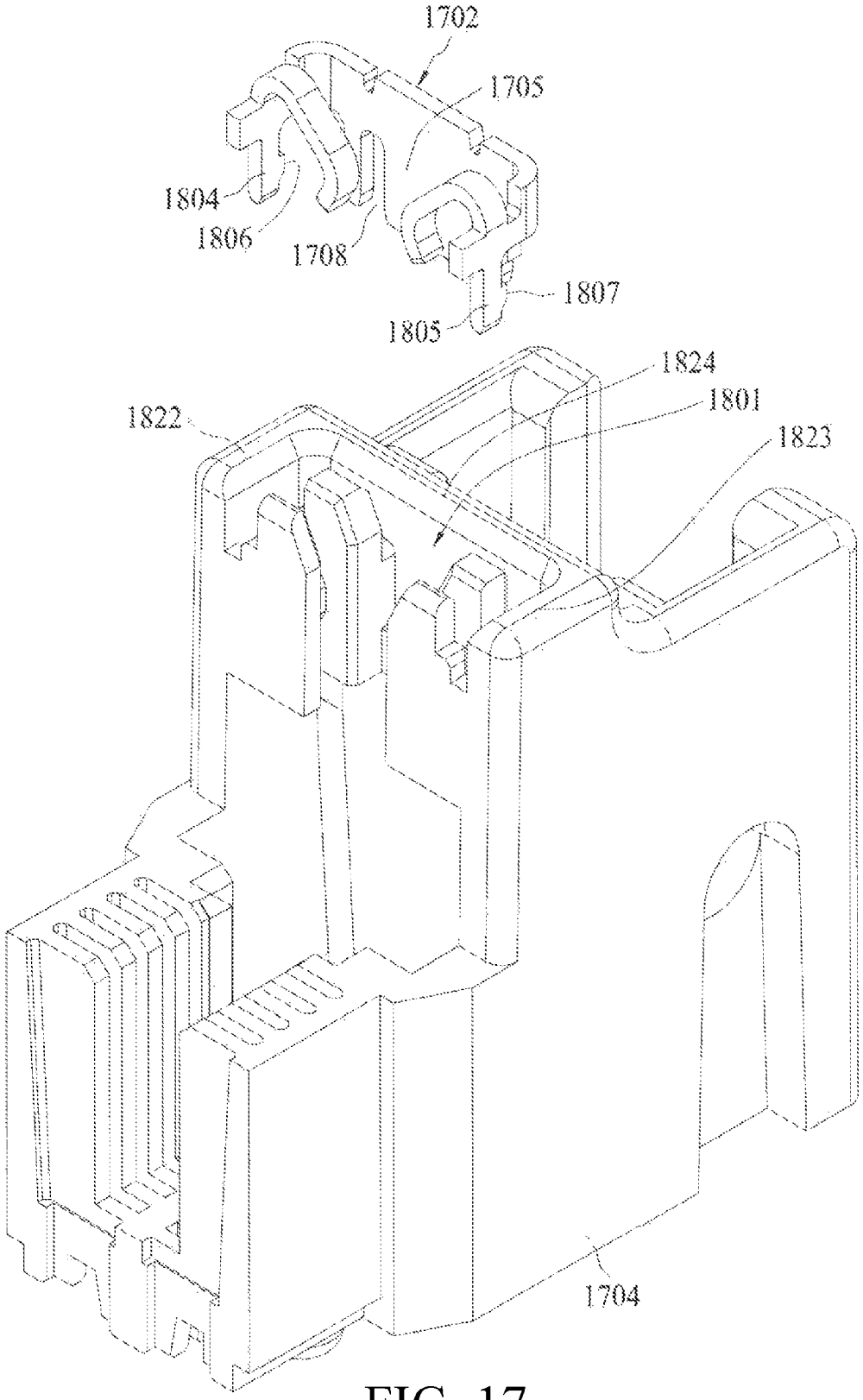
FIG. 17 is an exploded perspective view of a first metal strengthening member and a first tower in a second embodiment.
Figure 18:
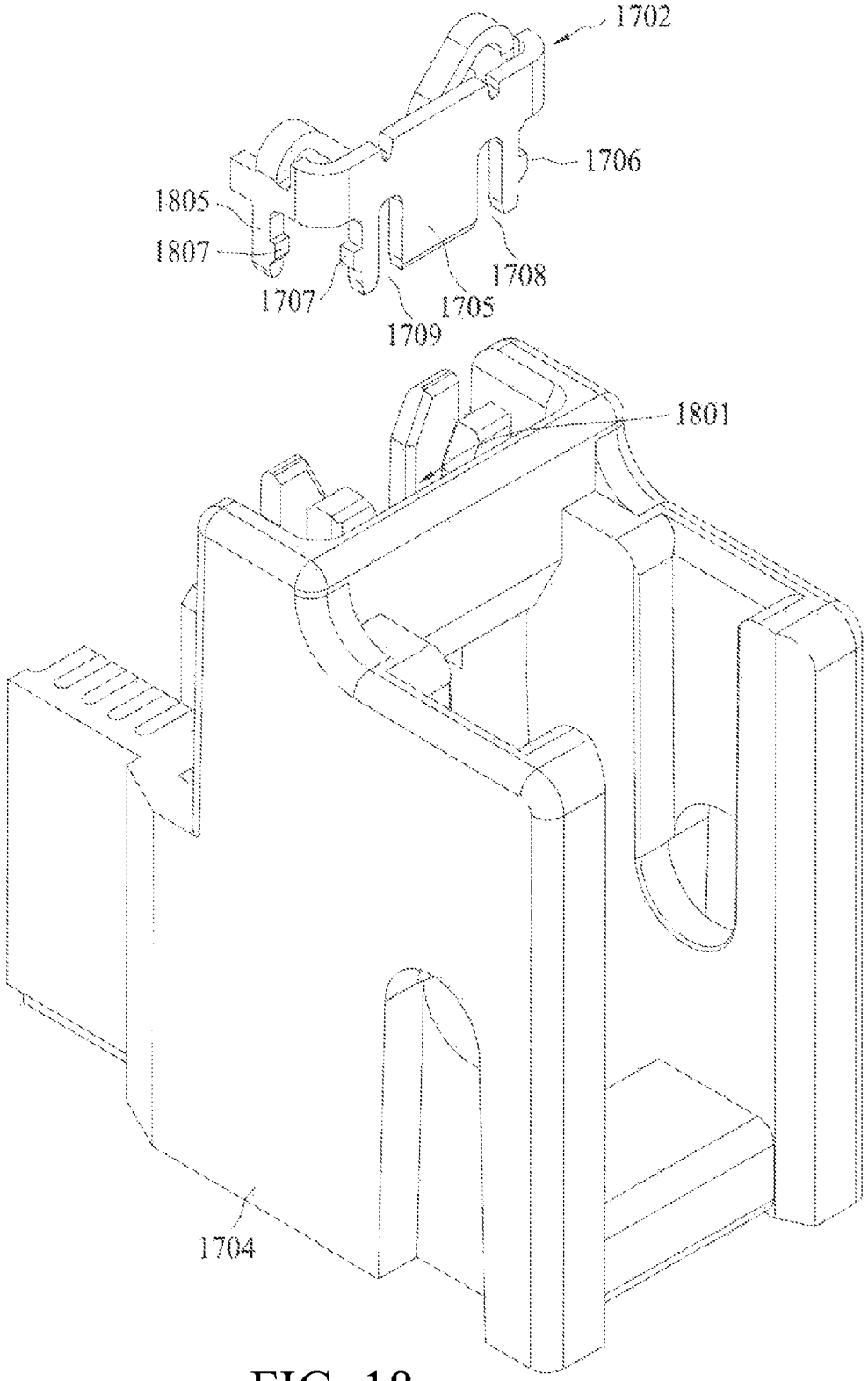
FIG. 18 is another exploded perspective view of the first metal strengthening member and the first tower in the second embodiment.
Figure 19:
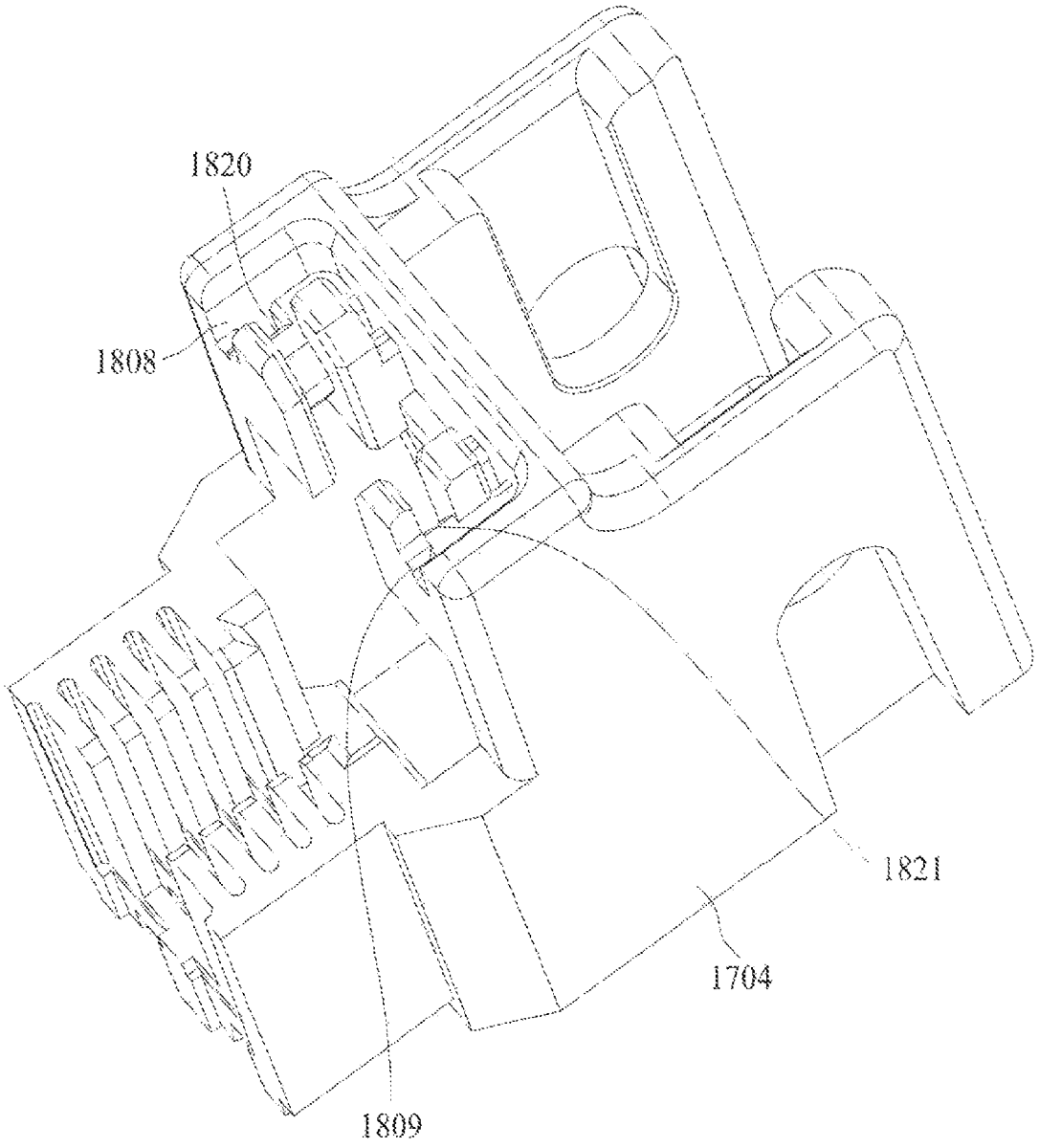
FIG. 19 is a partially enlarged view of the first tower in the second embodiment.
Figure 20:
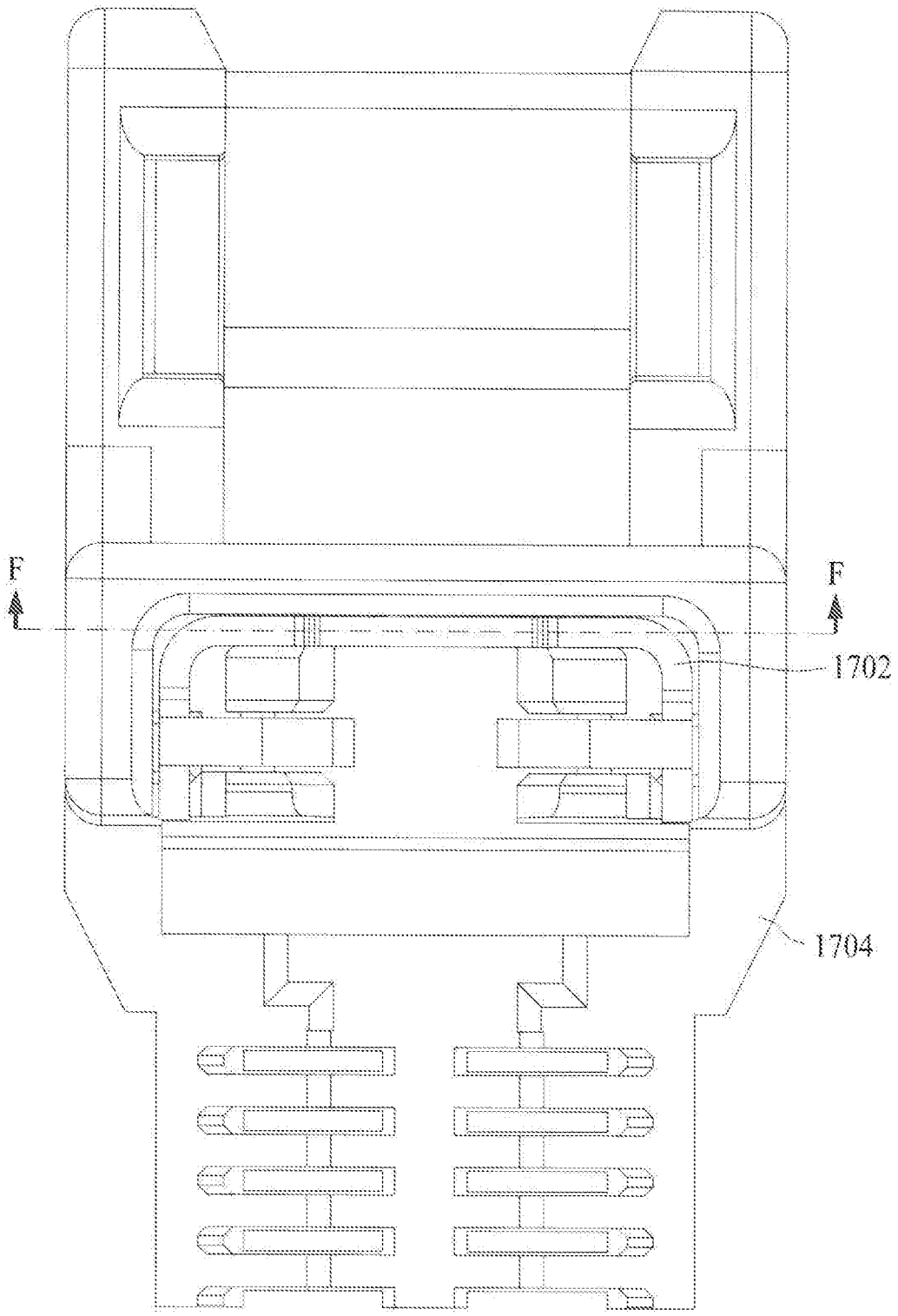
FIG. 20 is a partial top view viewed after the first metal strengthening member is mounted to the first tower in the second embodiment.
Figure 21:
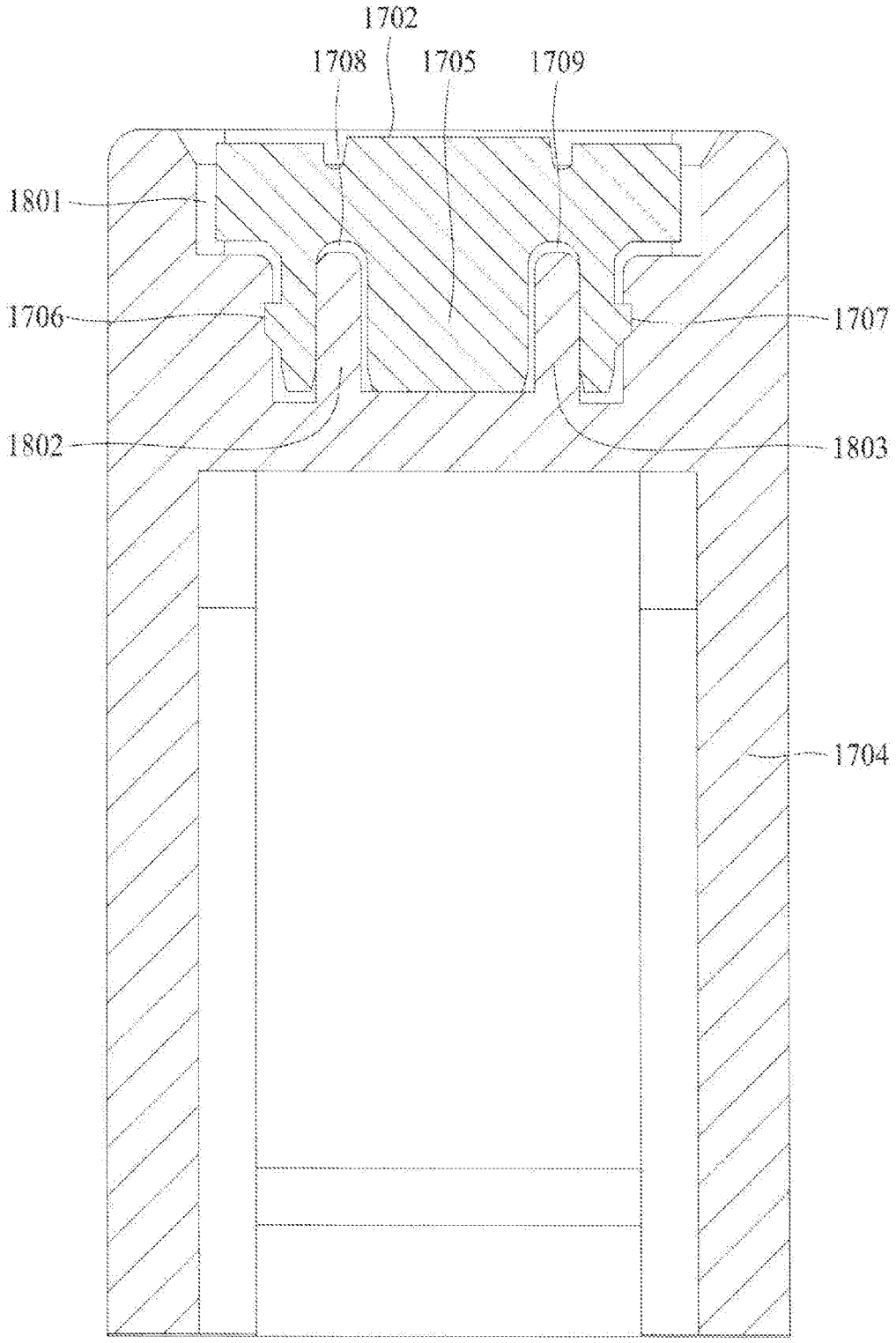
FIG. 21 is a cross sectional view taken along a line F-F of FIG. 20 in the second embodiment.

FIG. 17 is an exploded perspective view of a first metal strengthening member 1702 and a first tower 1704 in a second embodiment. FIG. 18 is another exploded perspective view of the first metal strengthening member 1702 and the first tower 1704 in the second embodiment. FIG. 19 is aally partially enlarged view of the first tower 1704 in the second embodiment. FIG. 20 is a partial top view viewed after the first metal strengthening member 1702 is mounted to the first tower 1704 in the second embodiment. FIG. 21 is a cross sectional view taken along a line F-F of FIG. 20 in the second embodiment. Referring to FIGS. 17-21 at the same time, in comparison with the first embodiment as shown in FIGS. 5-7, in the second embodiment, a fixed portion 1705 of a first metal strengthening member 1702 comprises a first interference protrusion 1706, a second interference protrusion 1707, a first notch 1708 and a second notch 1709. The first notch 1708 and the second notch 1709 are provided to allow the first interference protrusion 1706 and the second interference protrusion 1707 to be respectively formed to two cantilever arms. As shown in FIGS. 17-18, the two cantilever arms are respectively positioned at two sides of the fixed portion 1705. Therefore, when the fixed portion 1705 is disposed in a recessed portion of a third mounting groove 1801 of the first tower 1704, a first cantilever arm having the first interference protrusion 1706 and a second cantilever arm having the second interference protrusion 1707 will have an interference fix in a recessed portion of the third mounting groove 1801, as shown in FIGS. 20-21. it should be noted that, the first notch 1708 and the second notch 1709 can be formed between the two cantilever arms and the fixed portion 1705, therefore the recessed portion of the third mounting groove 1801 may be correspondingly provided with two protruding portions (which are respectively indicated by 1802 and 1803) therein with respect to the first notch 1708 and the second notch 1709, so that the two protruding portions are respectively engaged with the first notch 1708 and the second notch 1709, and allow the first metal strengthening member 1702 to be further fixed, as shown in FIG. 21.

Moreover, referring to FIGS. 17-19 again, in the second embodiment, a first side portion 1804 and a second side portion 1805 of the first metal strengthening member 1702 respectively comprise a first interference protrusion 1806 and a second interference protrusion 1807, a first mounting groove 1808 and a second mounting groove 1809 are respectively provided with a first recessed portion 1820 and a second recessed portion 1821. Therefore, after the first metal strengthening member 1702 is mounted to the first tower 1704, the first interference protrusion 1806 of the first side portion 1804 will be interference fixed to the first recessed portion 1820 and the second interference protrusion 1807 of the second side portion 1805 will be interference fixed to the second recessed portion 1821.

As can be seen from above description for the second embodiment, the fixed portion 1705, the first side portion 1804 and the second side portion 1805 of the first metal strengthening member 1702 all are fixed to the first tower 1704 by means of an interference fixing manner, therefore the second embodiment may further strengthen a connecting strength of a part of the first tower 1704 between a first side wall and a second side wall (which are respectively indicated by 1822 and 1823 in FIG. 17) of the first tower 1704 and prevent a connecting wall (which is indicated by 1824 in FIG. 17) from being deflected and in turn fractured.

The technical contents and the technical advantages are disclosed as above. However, a person skilled in relevant art shall understand that various substitutions and modifications may be made based on teaching and disclosure without departing from spirit and scope defined by the appended claims. For example, the manufacturing approaches disclosed as above may be implemented by various different approaches or be replaced by other manufacturing approaches, or the two type approaches can be combined.

The invention claimed is:

1. A card edge connector, comprising:

an insulating body, the insulating body comprising a card slot and a tower, the card slot extend long a first direction, the tower comprising a first side wall and a second side wall which extend along the first direction, a first guiding wall and a second guiding wall, the first guiding wall and the second guiding wall extending transversely to the first side wall and the second side wall respectively and facing each other, a first mounting groove being formed between the first side wall and the first guiding wall, a second mounting groove being formed between the second side wall and the second guiding wall, a guiding groove being formed between the first guiding wall and the second guiding wall; and a metal strengthening member comprising:

a base portion;

a first side portion and a second side portion extending respectively from two sides of the base portion toward the inside direction, the first and second side portions both extending from the base portion in a substantially perpendicular direction; and a first elastic arm and a second elastic arm extending inwardly and transversely, respectively, from the first side portion and the second side portion toward the guiding groove;

the first side portion and the second side portion being respectively mounted into the first mounting groove and the second mounting groove, the first elastic arm being adjacent to a side wall of the first guiding wall, extending transversely beyond a covering range of the side wall of the first guiding wall and extending into the guiding groove, the second elastic arm being adjacent to a side wall of the second guiding wall, extending transversely beyond a covering range of the side wall of the second guiding wall and extending into the guiding groove, wherein the first elastic arm comprises a first clamping portion, and the second elastic arm comprises a second clamping portion; the first clamping portion protrudes relative to the first guiding wall and protrudes into the guiding groove, and the second clamping portion protrudes relative to the second guiding wall and protrudes into the guiding groove so that the first clamping portion and the second clamping portion elastically clamp two sides of an electric card.

2. The card edge connector according to claim 1, wherein the first side portion comprises a first interference protrusion, and the second side portion comprises a second interference protrusion;

the first mounting groove is provided with a first recessed portion, and the second mounting groove is provided with a second recessed portion;

the first interference protrusion is interference fixed to the first recessed portion, and the second interference protrusion is interference fixed to the second recessed portion.

3. The card edge connector according to claim 1, wherein a first distal end of the first elastic arm extends toward the first side portion; and a second distal end of the second elastic arm extends toward the second side portion.

4. The card edge connector according to claim 3, wherein the first elastic arm comprises a first oblique surface, and the second elastic arm comprises a second oblique surface;

the first oblique surface extends obliquely and downwardly from an upper end of the first side portion toward the guiding groove, and the second oblique surface extends obliquely and downwardly from an upper end of the second side portion toward the guiding groove.

5. The card edge connector according to claim 1, wherein a first receiving groove is formed in a middle part of the first guiding wall, and a second receiving groove is formed in a middle part of the second guiding wall;

the first elastic arm comprises a first clamping portion, and the second elastic arm comprises a second clamping portion;

the first elastic arm is mounted in the first receiving groove and the second elastic arm is mounted in the second receiving groove;

the first clamping portion protrudes relative to the first receiving groove and protrudes into the guiding groove, and the second clamping portion protrudes relative to the second receiving groove and protrudes into the guiding groove.

6. The card edge connector according to claim 5, wherein the first guiding wall has a first guiding surface extending toward the guiding groove; and the second guiding wall has a second guiding surface extending toward the guiding groove.

7. The card edge connector according to claim 6, wherein the tower further comprises a connecting wall, the connecting wall connects the first side wall and the second side wall of the tower and the metal strengthening member is mounted along an inner side of the connecting wall.

8. The card edge connector according to claim 7, wherein the card edge connector further comprises:

a latching-ejecting member, the latching-ejecting member is pivoted attached to the tower, the latching-ejecting member has a latching portion at an upper end of the latching-ejecting member, and the latching-ejecting member has an ejecting portion at a lower end of the latching-ejecting member;

a latching-ejecting member mounting portion provided along an outer side of the connecting wall wherein the latching-ejecting member is positioned in the latching-ejecting member mounting portion.

9. The card edge connector according to claim 7, wherein the base portion of the metal strengthening member abuts against an inside surface of the connecting wall.

10. The card edge connector according to claim 9, wherein a third mounting groove is formed among the first guiding wall, the second guiding wall and the inside surface of the connecting wall, the base portion of the metal strengthening member is mounted in the third mounting groove.

11. The card edge connector according to claim 10, wherein the base portion of the metal strengthening member comprises a fixed portion, the fixed portion is fixed in the third mounting groove.

12. The card edge connector according to claim 11, wherein the fixed portion comprises an interference protrusion, the third mounting groove is provided with a recessed portion, the fixed portion is disposed in the recessed portion of the third mounting groove, and the interference protrusion is interference fixed to the recessed portion.

13. The card edge connector according to claim 12, wherein the fixed portion further comprises a notch so as to allow the interference protrusion to be formed on a cantilever arm, the cantilever arm having the interference protrusion is interference fixed to the recessed portion.

14. A card edge connector assembly, the card edge connector assembly being used for insertion of an electronic card, the card edge connector assembly comprising a circuit board and a card edge connector, the circuit board comprising a plurality of soldering points, the card edge connector comprising:

an insulating body, the insulating body comprising a card slot and a tower, the card slot extend long a first direction, the tower comprising a first side wall and a second side wall which extend along the first direction, a first guiding wall and a second guiding wall, the first guiding wall and the second guiding wall extending transversely to the first side wall and the second side wall respectively and facing each other, a first mounting groove being formed between the first side wall and the first guiding wall, a second mounting groove being formed between the second side wall and the second guiding wall, a guiding groove being formed between the first guiding wall and the second guiding wall, the electronic card being inserted into the card slot along the guiding groove;

a plurality of terminals arranged along the card slot; and a metal strengthening member comprising:

a base portion;

a first side portion and a second side portion extending respectively from two sides of the base portion toward the inside direction, the first and second side portions both extending from the base portion in a substantially perpendicular direction; and a first elastic arm and a second elastic arm extending inwardly and transversely, respectively, from the first side portion and the second side portion toward the guiding groove;

the plurality of terminals being respectively coupled to the plurality of soldering points, the first side portion and the second side portion being respectively mounted into the first mounting groove and the second mounting groove, the first elastic arm being adjacent to a side wall of the first guiding wall, extending transversely beyond a covering range of the side wall of the first guiding wall and extending into the guiding groove, the second elastic arm being adjacent to a side wall of the second guiding wall, extending transversely beyond a covering range of the side wall of the second guiding wall and extending into the guiding groove, wherein, in operation, when the electronic card is inserted into the card slot, the first elastic arm and the second elastic arm elastically clamp the electronic card from two sides of the electronic card, and the electronic card being electrically connected to the plurality of terminals, wherein the first elastic arm comprises a first clamping portion, and the second elastic arm comprises a second clamping portion; the first clamping portion protrudes relative to the first guiding wall and protrudes into the guiding groove, and the second clamping portion protrudes relative to the second guiding wall and protrudes into the guiding groove, so that the first clamping portion and the second clamping portion elastically clamp the electronic card from two sides of the electronic card.

15. The card edge connector assembly according to claim 14, wherein a first receiving groove is formed in a middle part of the first guiding wall, and a second receiving groove is formed in a middle part of the second guiding wall;

the first elastic arm comprises a first clamping portion, and the second elastic arm comprises a second clamping portion;

the first elastic arm is mounted to the first receiving groove, and the second elastic arm mounted to the second receiving groove;

the first clamping portion protrudes relative to the first receiving groove and protrudes into the guiding groove, and the second clamping portion protrudes relative to the second receiving groove and protrudes into the guiding groove, so that, in operation, the first clamping portion and the second clamping portion elastically clamp the electronic card from two sides of the electronic card.

16. The card edge connector assembly according to claim 15, wherein the first guiding wall has a first guiding surface extending toward the guiding groove; and the second guiding wall has a second guiding surface extending toward the guiding groove.

17. The card edge connector assembly according to claim 16, wherein the tower further comprises a connecting wall, the connecting wall connects the first side wall and the second side wall of the tower, the metal strengthening member is mounted at an inner side of the connecting wall.

18. The card edge connector assembly according to claim 17, wherein the card edge connector further comprises:

a latching-ejecting member, the latching-ejecting member is pivoted attached to the tower, the latching-ejecting member has a latching portion at an upper end of the latching-ejecting member, and the latching-ejecting member has an ejecting portion at a lower end of the latching-ejecting member;

a latching-ejecting member mounting portion provided along an outer side of the connecting wall wherein the latching-ejecting member is positioned in the latching-ejecting member mounting portion.

* * * * *